US009174784B2

(12) United States Patent
Bakx et al.

(10) Patent No.: US 9,174,784 B2
(45) Date of Patent: Nov. 3, 2015

(54) CARTON AND BLANK THEREFOR

(75) Inventors: Martinus C.M. Bakx, Goes LS (NL); John M. Holley, Jr., Lawrenceville, GA (US); Kyle Schumaker, Greer, SC (US); Bradford J. Walling, Chesterfield, VA (US)

(73) Assignee: WestRock Packaging Systems, LLC, Norcross, GA (US)

( * ) Notice: Subject to any disclaimer, the term of this patent is extended or adjusted under 35 U.S.C. 154(b) by 399 days.

(21) Appl. No.: 13/391,571

(22) PCT Filed: Jul. 19, 2010

(86) PCT No.: PCT/US2010/042386

§ 371 (c)(1),
(2), (4) Date: Jun. 20, 2012

(87) PCT Pub. No.: WO2011/022145

PCT Pub. Date: Feb. 24, 2011

(65) Prior Publication Data

US 2012/0248179 A1 Oct. 4, 2012

(30) Foreign Application Priority Data

Aug. 18, 2009 (GB) ..... 0914435.3

(51) Int. Cl.
*B65D 5/42* (2006.01)
*B65D 71/14* (2006.01)

(52) U.S. Cl.
CPC ..... *B65D 71/14* (2013.01); *B65D 2571/0066* (2013.01); *B65D 2571/00185* (2013.01); *B65D 2571/00197* (2013.01); *B65D 2571/00265* (2013.01); *B65D 2571/00271* (2013.01); *B65D 2571/00277* (2013.01); *B65D 2571/00444* (2013.01); *B65D 2571/00543* (2013.01); *B65D 2571/00765* (2013.01)

(58) Field of Classification Search
CPC ..... B65D 2571/0016; B65D 2571/00172; B65D 2571/00185
USPC ..... 229/120.14, 125.21, 198.2
See application file for complete search history.

(56) References Cited

U.S. PATENT DOCUMENTS

| | | | | |
|---|---|---|---|---|
| 2,120,470 | A * | 6/1938 | Patterson | 229/198.2 |
| 3,111,797 | A | 11/1963 | Englander et al. | |
| 3,175,684 | A | 3/1965 | Andre et al. | |
| 3,186,545 | A | 6/1965 | Conrades | |
| 3,356,283 | A | 12/1967 | Champlin | |
| 3,367,557 | A | 2/1968 | Farquhar | |
| 3,767,042 | A * | 10/1973 | Ganz | 206/197 |
| 4,093,116 | A | 6/1978 | Watkins et al. | |

(Continued)

FOREIGN PATENT DOCUMENTS

| | | | |
|---|---|---|---|
| EP | 1454841 | A1 | 9/2004 |
| FR | 2824537 | A1 | 11/2002 |

(Continued)

*Primary Examiner* — Christopher Demeree
(74) *Attorney, Agent, or Firm* — WestRock Intellectual Property Group

(57) ABSTRACT

An arrangement for locking together two panels (50, 60) the arrangement comprising a first and second male tabs (39*a*, 39*b*) and a first and second female tabs (43) wherein the first and second male tabs are hinged to a first panel by a first and second hinged connection (41) respectively, and the first female tabs are hinged to a second panel by a third hinged connection the first and second hinged connections being divergent with respect to one another.

18 Claims, 18 Drawing Sheets

(56) References Cited

U.S. PATENT DOCUMENTS

| | | | | |
|---|---|---|---|---|
| 4,139,146 | A | | 2/1979 | Bamburg et al. |
| 4,773,540 | A | | 9/1988 | Schuster |
| 5,004,147 | A | | 4/1991 | Bienaime |
| 5,131,588 | A | * | 7/1992 | Oliff ..... 229/198.2 |
| 5,328,080 | A | | 7/1994 | Holley |
| 5,484,059 | A | | 1/1996 | Sutherland |
| 6,135,347 | A | | 10/2000 | Mueller |
| 6,289,651 | B1 | | 9/2001 | LeBras |
| 6,926,195 | B1 | | 8/2005 | Rhyne et al. |

FOREIGN PATENT DOCUMENTS

| | | | |
|---|---|---|---|
| JP | 200813894 | | 9/2008 |
| WO | 93-08085 | | 4/1993 |
| WO | 9911538 | A1 | 3/1999 |
| WO | 03004793 | A1 | 6/2003 |
| WO | 2005/042370 | A1 | 5/2005 |

* cited by examiner

CARTON AND BLANK THEREFOR

This application is a National Phase application of PCT Application PCT/US10/042386 filed Jul. 19, 2010, which claims the benefit of GB Application No. 0914435.3, filed Aug. 18, 2009, each of which is incorporated herein by reference in their entirety.

FIELD OF THE INVENTION

This invention relates to panel interlocking means for securing together a pair of panels, for example, overlapping panels of a carton. In some situations, these panels are provided by the opposite ends of a paper-board wrapper blank, which opposite ends are brought together and interlocked.

BACKGROUND OF THE INVENTION

It is known to interlock a pair of panels together using locking tabs which are struck from one panel (for example one end of a carton wrapper). The locking tabs are arranged to be driven or punched through corresponding apertures, defined by retaining tabs, struck from another panel (for example the opposite end of a carton wrapper). Such "punch-locks" are known and are illustrated, for example, in U.S. Pat. Nos. 4,093,116 and 5,131,588.

It is desirable, for cost saving and environmental reasons to use lighter weight material, particularly for paperboard and plastics packaging and to have more flexibility in terms of the positioning of the locking mechanisms. It is for these and other reasons that the present invention seeks to provide an improvement in the field of panel interlocking mechanisms.

SUMMARY OF INVENTION

According to a first aspect, the invention provides an arrangement for locking together two panels the arrangement comprising a first and second male tabs and a first and second female tabs wherein the first and second male tabs are hinged to a first panel by a first and second hinged connection respectively, and the first female tabs are hinged to a second panel by a third hinged connection the first and second hinged connections being divergent with respect to one another.

Preferably, the male tabs are orientated such that the first and second fold lines are disposed at an angular relationship to a free end edge of the first panel.

Preferably, the first and second fold lines are disposed at an angle less than 90° or greater than 90°.

Preferably, the first and second fold lines are disposed at an angle of substantially 45° to the free end edge of the first panel.

Preferably, the first and second fold lines are arranged to be substantially perpendicular to one another.

Preferably, the first and second fold lines are divergent towards a free end edge of the first panel.

Preferably the first and second fold lines are divergent away from a free end edge of the first panel.

Preferably, a third male tab hinged along a fifth hinged connection to the first panel, wherein the first, second and fifth hinged connections are each disposed divergently with respect to one another.

Preferably, the first and second fold lines are in contacting relationship with one another so as to form a vortex.

Preferably, there comprises a second female tab hinged to the second panel along a fourth hinged connection.

Preferably, the third hinged connection is disposed at an angular relationship to a free end edge of the second panel.

Preferably, the third and fourth hinged connection and disposed at an angular relationship to one another and/or to a free end edge of the second panel.

Preferably, a free end or side edge of the/or each female tab is shaped and arranged so as to encourage the tale tabs or respective male tab to fold in an angular relationship to a free end edge of the first panel.

Preferably, the male tabs are shorted in width than the female tabs.

According to a second aspect the invention provides an arrangement for locking together two panels, the arrangement comprising a male tab formed in a first of said panels and a female tab formed in a second of said panels, the arrangement operable to lock the two panels together once the two panels are overlaid by displacing together the male tab and female tab out of the plane of the overlaid panels, the male tab and female tab each comprise a base portion hinged to the respective panel in which they are formed and spaced apart side edges, wherein the female tab comprises means for engaging a side edge of the male tab for locking the displaced tabs together and thereby locking the first and second panels together.

According to a third aspect, the invention provides an arrangement for locking together two panels, the arrangement comprising a male tab formed in a first of said panels and a female tab formed in a second of said panels, the arrangement operable to lock the two panels together once the two panels are overlaid by displacing together the male tab and female tab out of the plane of the overlaid panels, the male tab and female tab each comprise a base portion hinged to the respective panel in which they are formed and spaced apart side edges, wherein the male tab is separable into two male tabs and said female tab is insertable between those two male tabs for spacing those two male tabs apart and locking the displaced female and male tabs together, thereby locking the first and second panels together.

Optionally, the male tab is separable into two male tabs and said female tab is insertable between those two male tabs for spacing those two male tabs apart and locking the displaced tabs together, thereby locking the first and second panels together.

Optionally, the female tab comprises a shoulder portion and a head portion arranged to form a catch in which a side edge of a male tab is engageable.

Optionally, the shoulder portion is an oblique edge of the female tab and the male tab is displaced such that an underneath surface of the male tab abuts the oblique edge.

Optionally, the male tab hinges about an oblique edge which is formed in the second panel once the female tab is displaced out of the plane of the second panel.

Optionally, wherein the male tab is encouraged to form a natural hinge about the oblique edge by virtue of one side edge of the male tab terminating at a point off-set from the terminus of the other spaced side edge.

Optionally, the male tab is hingeable about one or more fold lines angled obliquely relative to a notional central axis of the male tab.

Preferably the male tab comprises a cut line which separates the male tab into two male tabs and each of said two male tabs hinges about a fold line angled obliquely relative to that cut line such that the two male tabs are encouraged to fold away from one another, wherein the female tab comprises two oblique shoulder portions and a head, which head is disposable between those two male tabs such that a spaced edge of each of the two male tabs is engageable in a catch formed between the head and each oblique shoulder portion of the female tab.

Optionally, a fold line of the male tab and oblique edge of the female tab are similarly angled so that the male tab hinges about its fold line and about an edge which is formed in the second panel once the female tab is displaced out of the plane of the second panel and wherein said fold line and edge are substantially overlaid in parallel relationship.

Optionally, the male tab comprises a bulging shoulder portion shaped and sized to engage a portion of the second panel close to an edge (E) which is formed in the second panel once the female tab is displaced out of the plane of the second panel.

A carton comprising two panels interlocked by an arrangement as defined in any of the preceding paragraphs.

A package comprising a plurality of articles and a carton as defined in the immediately preceding paragraph.

BRIEF DESCRIPTION OF THE DRAWINGS

Exemplary embodiments of the invention will now be described with reference to the accompanying drawings, in which.

DETAILED DESCRIPTION OF PREFERRED EMBODIMENTS

Figure 1:
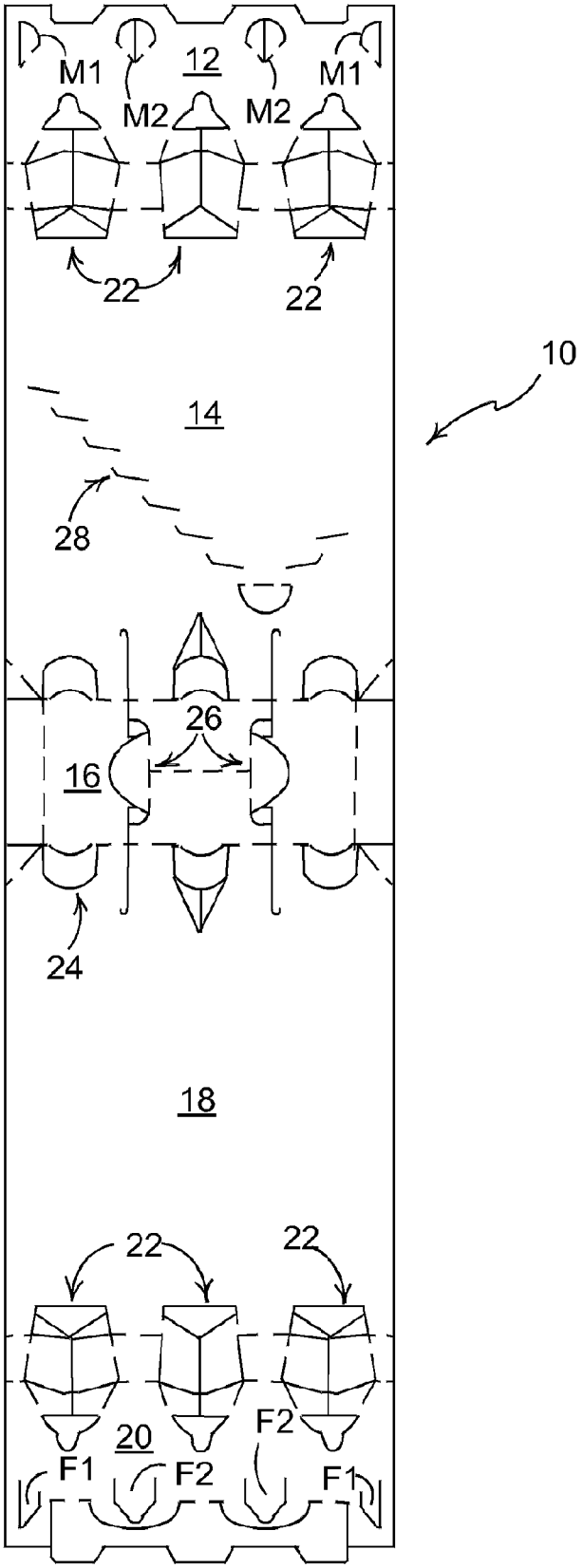
FIG. 1 is a plan view of a blank for forming a wraparound carton having panel interlocking means for interlocking bottom panels of the blank together for securing the wraparound carton in a set-up condition.

Specific embodiments of the invention will now be described. The embodiments are examples and as such do not represent an exhaustive record of all of the ways in which the invention could be implemented. The law does not require, and it would be prohibitive to describe and illustrate every possible variation and combination of the way in which the invention could be put into effect. The detailed description of each of the exemplary embodiments contains specific details in order to provide the reader with an understanding of the invention; however the invention may be implemented without these particular details.

In the different exemplary embodiments described, like reference numerals have, where possible, been used to indicate like features in each of the illustrated embodiments, albeit, the pre-fix '100' and '200' used to distinguish the different embodiments from one another.

Figure 3:
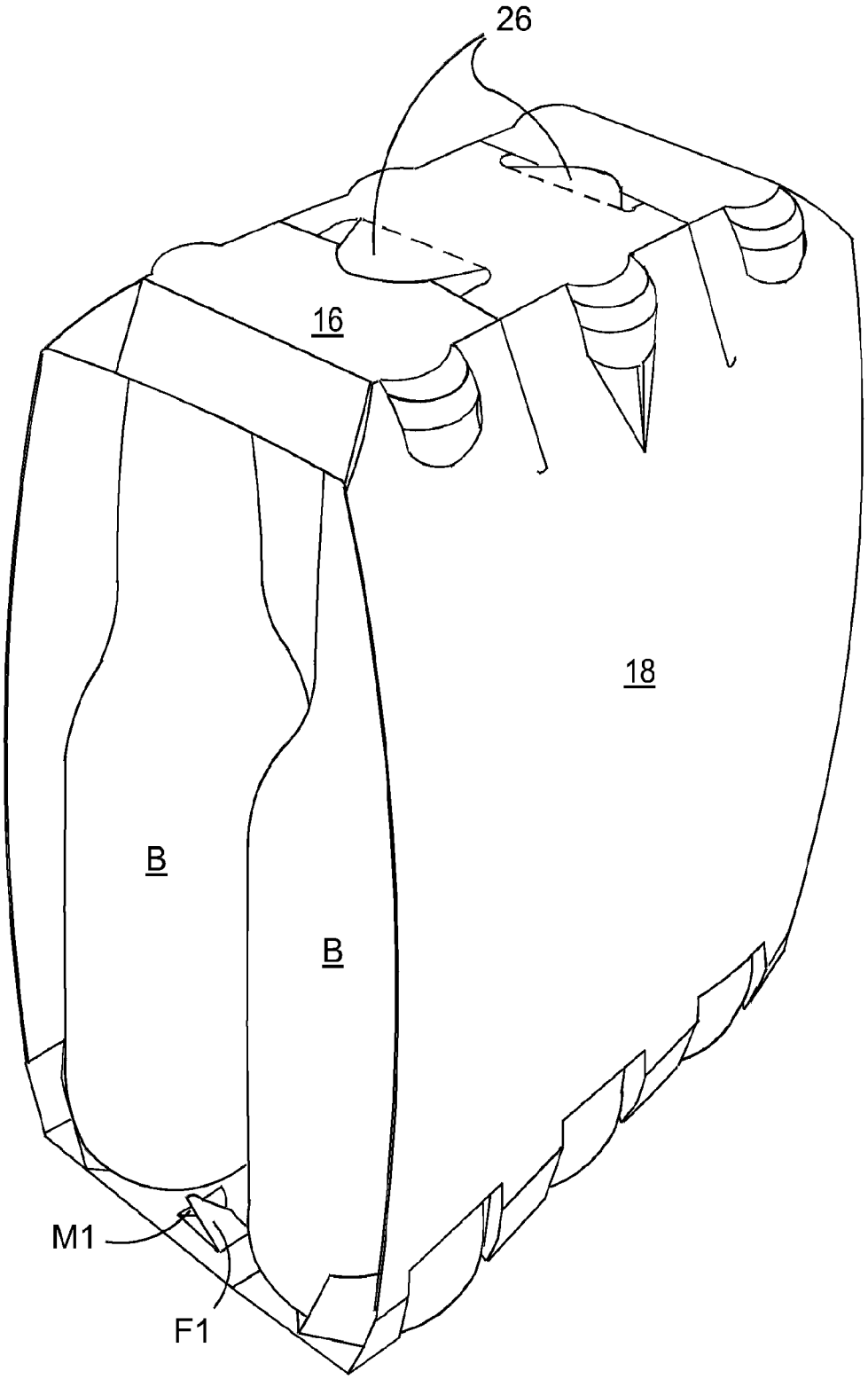
FIG. 3 is a perspective illustration of the wraparound carton formed from the blank of FIG. 1, wherein the "half-version" panel interlocking means can be seen at the bottom of the carton.

Turning now to FIG. 1, there is shown a blank 10 of foldable sheet material, such as paperboard or plastics material, for forming a wraparound style carton 30 illustrated in FIG. 3. The blank 10 is sized, shaped and configured to securely hold six bottles B in a 2×3 arrangement. It will be understood from reading the foregoing description that the panel interlocking means described could be utilised in a number of applications. The panel interlocking means has a beneficial application in the field of packaging, however the style of packaging, materials from which the packaging are formed, articles to be packaged and number of articles packaged may be selected from many various options and as such the blank 10 and carton 30 formed therefrom represent only one of many different ways in which the invention can be put into effect.

The blank 10 comprises a plurality of panels hinged one to the next in series including: first bottom panel 12, first side panel 14, top panel 16, second side panel 18 and second bottom panel 20. The blank 10 further comprises a number of entirely optional features for securing the articles B within the carton 30 once formed, these include: heel locking apertures 22, tear access opening means 28, bottle top securing apertures 24 and handling means 26. These features do not form part of the invention and are not further described.

The first and second bottom panels 12, 20 of the blank 10 are provided with panel interlocking means according to a first embodiment of the invention. Two variations of the first embodiment are shown corresponding to a "half-version" (IM1) and a "full-version" (IM2). The "male" elements Ml, M2 of both variations (IM1, IM2) are struck from first bottom panel 12, whereas the "female" elements Fl, F2 of both variations (IM1, IM2) are struck from the second bottom panel 20.

Figure 2:
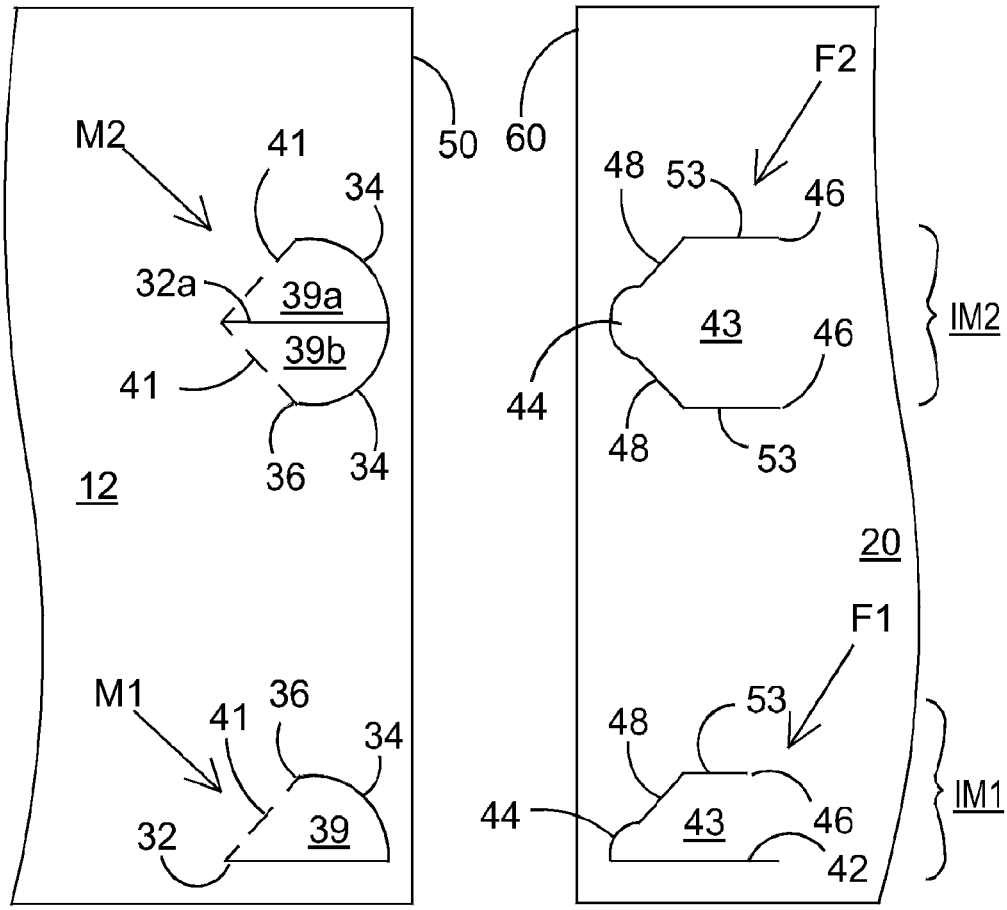
FIG. 2 is an enlarged view of a portion of the blank of FIG. 1 showing a "full-version" and a "half-version" of the panel interlocking means of a first embodiment of the invention.

A close up view of the first and second bottom panels 12, 20 is shown in FIG. 2. The first variation of the panel interlocking means (IM1) comprises male element M1 and female element F1. The male element M1 is defined by an arcuate cutline 34 and a linear cut line 32. A first terminus of arcuate cut line 34 is co-incident with the terminus of linear cut line 32. From this point the arcuate cut line 34 and linear cut line 32 diverge with the area between them representing a male tab 39 of the male element M1. The other terminus of arcuate cut line 34 is co-incident with an optional fold line or hinged connection 41 which extends between the cut line 32 and arcuate cut line 34. Preferably the non-co-incident terminals of arcuate cut line 34 and linear cut line 32 are off-set from one another and spaced from one another both in the horizontal and the vertical axes of the panel 12. As such the optional hinge line 41 is angled.

The male tab 39 is foldable, about hinge line 41, out of the plane of first bottom panel 12. The male tab 39 is insertable into an aperture created by the male tab displacing the female element F1 out of the plane of second bottom panel 20. The female element F1 is defined by a linear cut line 42, a head portion 44, an oblique shoulder portion 48 and a second linear cut line 53. The head portion 44 is defined by a rounded end.

The second variation (IM2) of the panel interlocking means according to the first embodiment of the invention is also illustrated in enlarged view in FIG. 2. In effect the male element M2 comprises two male elements of the M1 type disposed adjacent one another in mirrored fashion. As such, the male element M2 comprises a pair of male tabs 39*a*, 39*b* that are defined by two continuous and arcuate cut lines 34 disposed side-by-side. Male tabs 39*a*, 39*b* are separated by a linear cut line 32*a*. A first terminus of linear cut line 32*a* is co-incident with a mid-point of the two continuous and arcuate cut lines 34. A second terminus of linear cut line 32*a* is off-set from and spaced in both the horizontal and the vertical axes of the first bottom panel 12 from the terminals of the arcuate cut lines 34. Optional oblique fold lines 41 connect the second terminus of linear cut line 32*a* with the adjacent terminus of each arcuate cut line 34.

The hinge lines 41 of the male elements M1 and M2 of both variations of the first embodiment serve to control the direction of the displacement of the male tabs 39, 39*a*, 39*b* out of the plane of first bottom panel 12.

In the second variation (IM2) of the panel interlocking means according to the first embodiment of the invention, the female element F2 effectively is a pair of female elements Fl disposed adjacent one another in mirrored fashion, albeit without a central slit line. The female element F2 comprises a single head 44; two oblique shoulder portions 48 and two further cut lines 53 terminating at points 46. The female tab 43 thereby defined is displacable out of the plane of the second bottom panel 20 as a unitary piece that remains hingedly joined to the second bottom panel 20.

Figure 4:
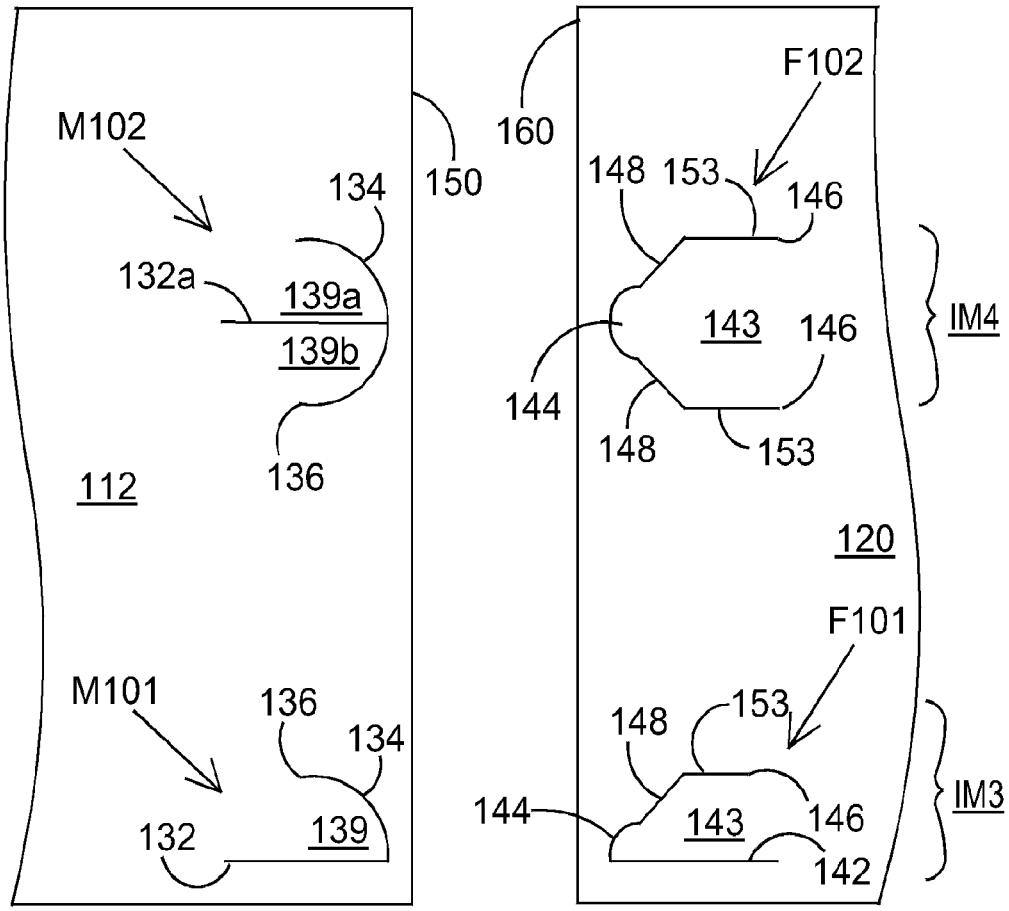
FIG. 4 is an enlarged view of a portion of a blank (similar to that shown in FIG. 1), wherein a "full-version" and a "half-version" of a panel interlocking means according to a second embodiment of the invention are shown.

A second embodiment of the panel interlocking means is shown in FIG. 4. Again there are two variations (IM3 and IM4) of the interlocking elements of the second embodiment corresponding to a "half-version" (IM3) and a "full-version" (IM4). The variations of the second embodiment differ from those of the first embodiment only in that the optional fold lines 41 are not provided in the male elements M101 and M102.

A first method of interlocking the panels will now be described with reference to the "full version" (IM4) and then with reference to the "half-version" (IM3) of the second illustrated embodiment.

Figure 5:
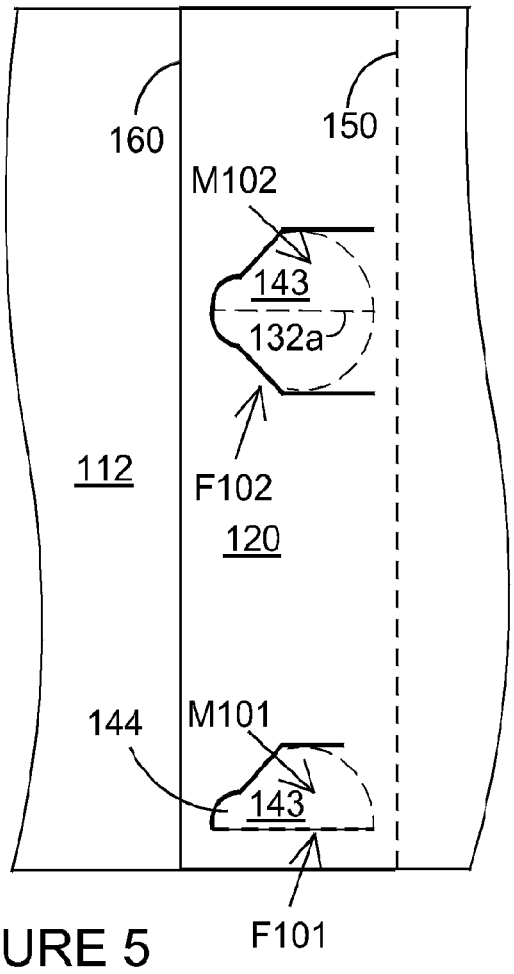
FIG. 5 is a schematic illustration of the two panels of FIG. 4 overlaid on top of one another with the top panel shown in a transparent view such that features of the underneath panel, that would normally be obscured from view, can be seen; these features are shown in dotted outline.

The first step in interlocking the first and second bottom panels 112, 120 is to position the second bottom panel 120 on top of the first panel 112. This first step is illustrated in FIG. 5. The second bottom panel 120 is shown as being transparent so that the male elements M101 and M102 of the first bottom panel 112 (that would otherwise be obscured from view) can be seen. The male elements M101 and M102 are shown in dotted outline.

The second step in interlocking the first and second bottom panels 112, 120 is to apply a force to push the male tab 139 against the female tab 143 and to push the female tab 143 out of the plane of second bottom panel 120. As the female tab 143 is displaced out of the plane of the second bottom panel 120, a natural crease 162 is formed between the terminals 146 and a gap 'G' is formed between the head 144 of the female tab 143 and the second bottom panel 120. The force applied to the male tabs 139*a*, 139*b* causes those male tabs 139*a*, 139*b* to be pushed through the gap 'G'. As the male tabs 139*a*, 139*b* are folded out of the plane of the first bottom panel 112 a natural crease 164*a*, 164*b* is formed along a notional line between the terminus 136 of each arcuate cut line 134 and the end of linear cut line 132*a*. The rounded shape and size of the head 144 of the female tab 143 encourages the male tabs 139*a*, 139*b* to separate or diverge. The male tabs 139*a*, 139*b* are caused to fold or crease 164*a*, 164*b* about the edges ('E') of the aperture created by displacement of the female tab 143. Similarly, the off-set nature of the terminus 136 of each arcuate cut line 134 and the end of linear cut line 132*a* means that the natural creases 164*a*, 164*b* are formed in an oblique manner and in substantially parallel alignment with the oblique shoulders 148 of the female element F102. This also encourages the male tabs 139*a*, 139*b* to move either side of the central head 144.

Figure 6:
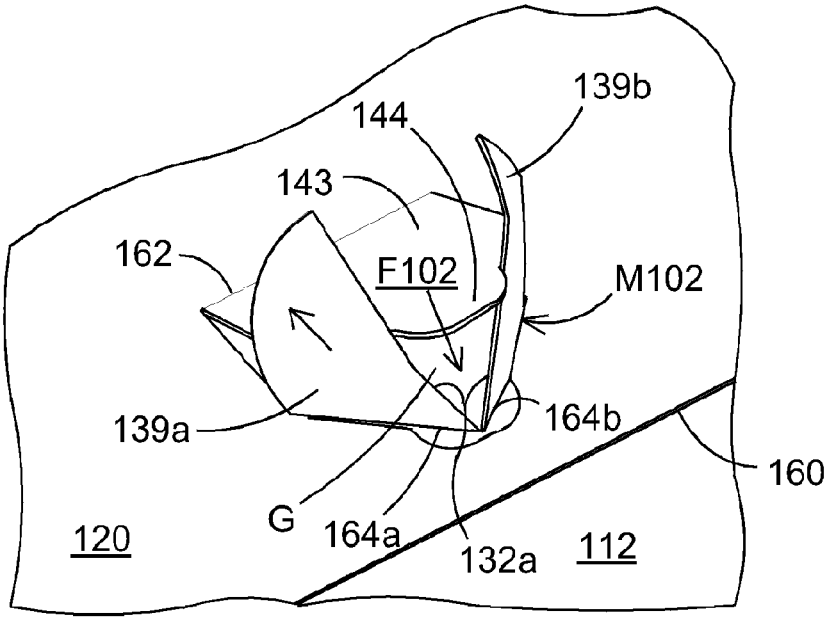
FIGS. 6, 7 and 8 are perspective views of the two variations of panel interlocking means of the second embodiment of the invention wherein the interlocking means has been deployed to secure the panels together.

Once the upward pushing force is no longer applied, the folded tabs 143, 139*a*, 139*b* will attempt to relax. The natural resilience of the paperboard along the naturally formed creases 162, 164*a*, 164*b* will mean that the displaced tabs 143, 139*a*, 139*b* will try and return to their unfolded planar state. However it is not possible for the displaced tabs 143, 139*a*, 139*b* to return to their unfolded planar state because the male tabs 139*a*, 139*b* have been pushed past the edges of the female tab 143, and as the female tab 143 relaxes and wedges between the male tabs 139*a*, 139*b*, the male tabs 139*a*, 139*b* are pushed further apart from one another. At the same time the male tabs 139*a*, 139*b* are attempting to relax back to their planar position which is in the opposite direction to the direction in which the female tab 143 is attempting to move. The female tab 143 and male tabs 139*a*, 139*b* therefore act in opposition to one another and prevent each other from returning to their unfolded states. The opposing forces of the tabs 143, 139*a*, 139*b*, helps maintain the female tab 143 in locking engagement with the male tabs 139*a*, 139*b*. The angle at which the male tabs 139*a*, 139*b* fold is guided by edge 'E' and is preferably in substantially parallel alignment with the oblique shoulder portions 148 which further assists the locking engagement of each male tab 139*a*, 139*b* against an oblique shoulder portion 148 of the female tab 143. These factors contribute to the secure interlocking of the first and second bottom panels 112, 120. Furthermore, the linear edge 132 of the male tabs 139*a*, 139*b* may catch in a nook between the head 144 and oblique shoulder 148 to further stabilise the locked inter-engagement of the tabs 143, 139*a*, 139*b*. FIG. 6 illustrates the locking engagement of the male tabs 139*a*, 139*b* with the female tab 143.

Figure 7:
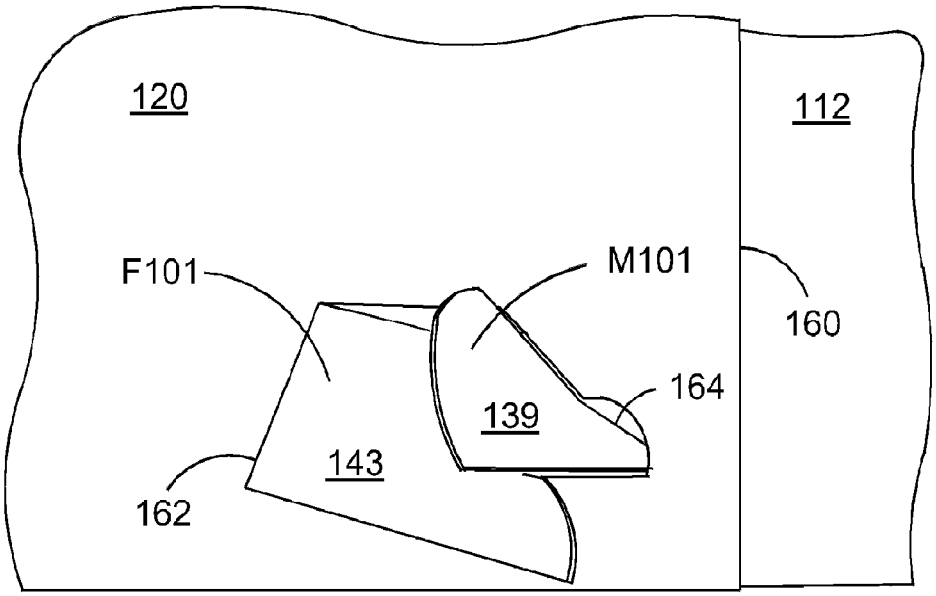

Turning now to the interlocking of the "half-version" (IM3) of the second embodiment. The male tab 139 is forced (by an external force) in an upward direction. The applied force also displaces the female tab 143 out of the plane of the second bottom panel 120. In a similar way as is described above, the male tab 139 is pushed past the oblique shoulder edge 148 of the female tab 143. Once the force is removed, the female tabs 143 each attempt to fold back to their planar positions. To achieve this, the female and male tabs 143, 139 attempt to fold in opposing directions. As the female tab 143 attempts to relax to its planar position, the head portion 144 prevents the male tab 139 from relaxing back to its planar position. Likewise the presence of the male tab 139 and the angle of its hinge connection prevents the female tab 143 from completely relaxing into its original planar state and the opposing requirements of the tabs 143, 139 result in an interlocked equilibrium wherein the male tab 139 abuts the oblique shoulder 148 of female tab 143. FIG. 7 illustrates the locking engagement of the male tab 139 with the female tab 143.

Figure 8:
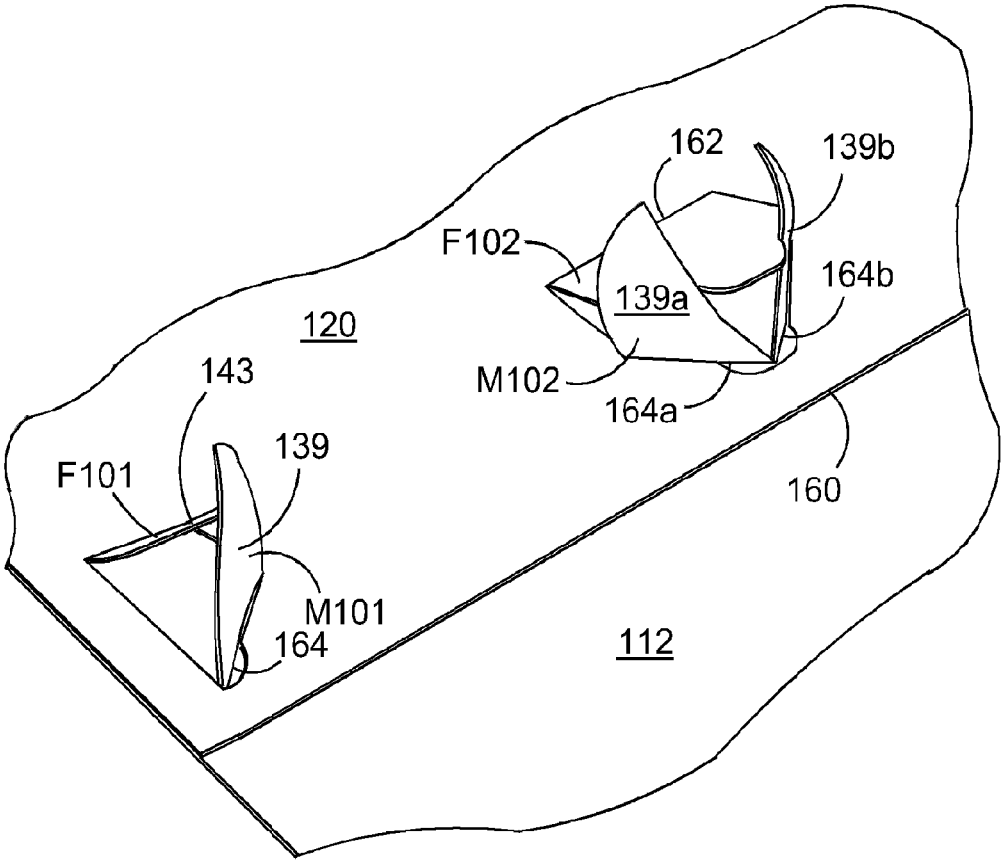

FIG. 8 illustrates the locking engagement of the male tabs 139*a*, 139*b* with the female tab 143 of the "full-version" (IM4) and the locking engagement of the male tab 139 with the female tab 143 of the "half-version" (IM3).

The interlocking of the "full-version" (IM2) and "half-version" (IM1) of the locking arrangements of the first embodiment can be carried out in the same way as described above. The specific demarcated fold line or hinge line 41 facilitates the obliquely angled folding of the male tabs 39, 39*a*, 39*b* against edge 'E' and encourages the male tabs 139, 139*a*, 139*b* to abut the similarly angled oblique shoulder portions 48 of the female tab 43.

In a second, alternative, method of interlocking the first and second bottom panels 12; 112, 20; 120 together using the locking mechanisms described, the first bottom panel 12; 112 is disposed on top of the second bottom panel 20; 120. An external force is applied to push the female tab 43; 143 upwardly out of the plane of the second bottom panel 20; 120. The male elements M1, M2, M101, M102 being disposed on top of the female elements F1, F2, F101, F102. The external force is also used to displace the male tabs 39; 39*a*, 39*b*, 139; 139*a*, 139*b* out of the plane of the first bottom panel 12; 112. The female tab 43, 143 is pushed out of the plane of the second panel 20; 120 and pushed through a gap created by the male tab(s) 39; 39*a*, 39*b*, 139; 139*a*, 139*b* being displaced. The head portion 44; 144 is pushed past the linear cut line 32, 32*a*; 132, 132*a* so that the female tab is also displaced out of the plane of the first bottom panel 12; 112, In this way the female tab 43; 143 and the or each male tab 39; 39*a*, 39*b*, 139; 139*a*, 139*b* are both upstanding from the first bottom panel 12; 112. Once the external force is removed, the locking tabs 43; 143, 39; 39*a*, 39*b*, 139; 139*a*, 139*b* attempt to relax to their natural, unfolded positions (due to the natural resilience of the paperboard material).

The locking tabs 43; 143, 39; 39*a*, 39*b*, 139; 139*a*, 139*b* attempt to move in opposite directions in order to achieve this until an equilibrium position is reached where neither female tab 43; 143 or male tab 39; 39*a*, 39*b*, 139; 139*a*, 139*b* can move because of the other. In this position, the oblique shoulder portion 48; 148 of the female tab 43; 143 abuts the underside of the adjacent male tab 39; 39*a*, 39*b*, 139; 139*a*, 139*b*. Additionally the head 44; 144 of the female tab 43; 143 and adjacent oblique shoulder portion 48; 148 create a nook into which the edge defined by the linear cut line 32, 32*a*,; 132, 132*a* is caught.

In the "full-versions" (IM2, IM4), the female locking head 44; 144 also serves to push apart the male tabs 39*a*, 39*b*; 139*a*, 139*b* thus further restricting those male tabs 39*a*, 39*b*; 139*a*, 139*b* from relaxing into their unfolded positions and thus increasing the tension set-up in the interlocked arrangement. This assists in creating a stronger more secure locking mechanism. The second method of engaging the interlocking means (IM1, IM2, IM3, IM4) is not illustrated in the attached figures.

The second method of engaging the interlocking means (IM1, IM2, IM3, IM4) is not illustrated in the attached figures.

Figure 9:
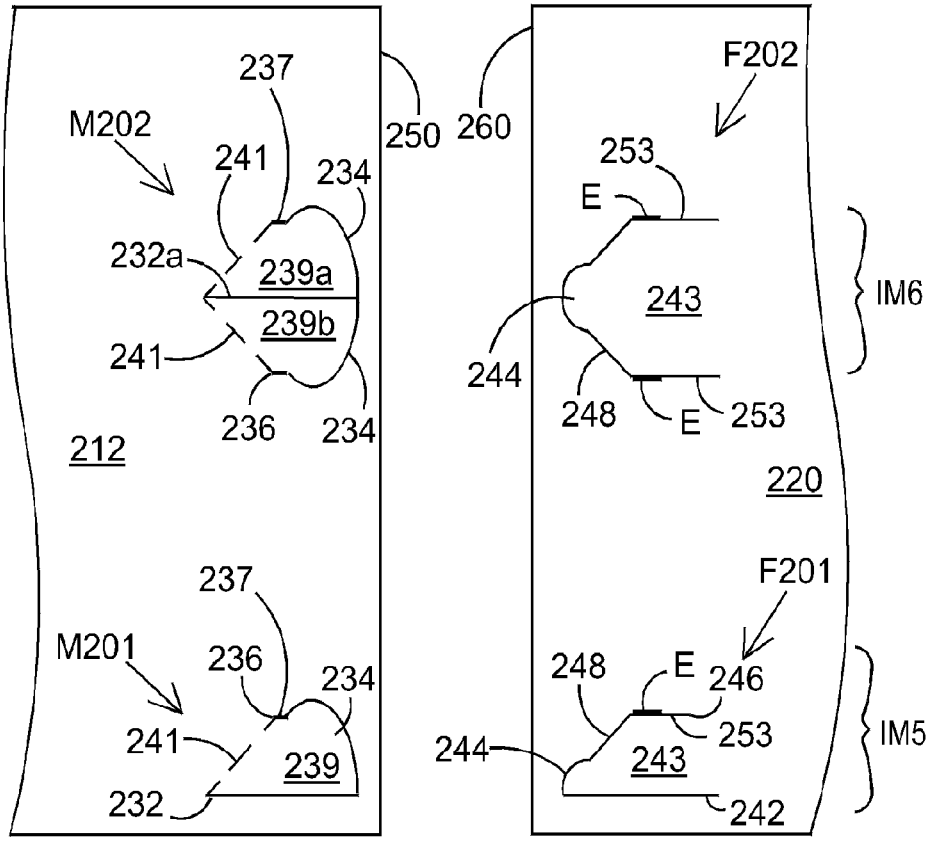
FIG. 9 is an enlarged view of a portion of a blank (similar to that shown in FIG. 1), wherein a "full-version" and a "half-version" of a panel interlocking means according to a third embodiment of the invention are shown.
Figure 10:
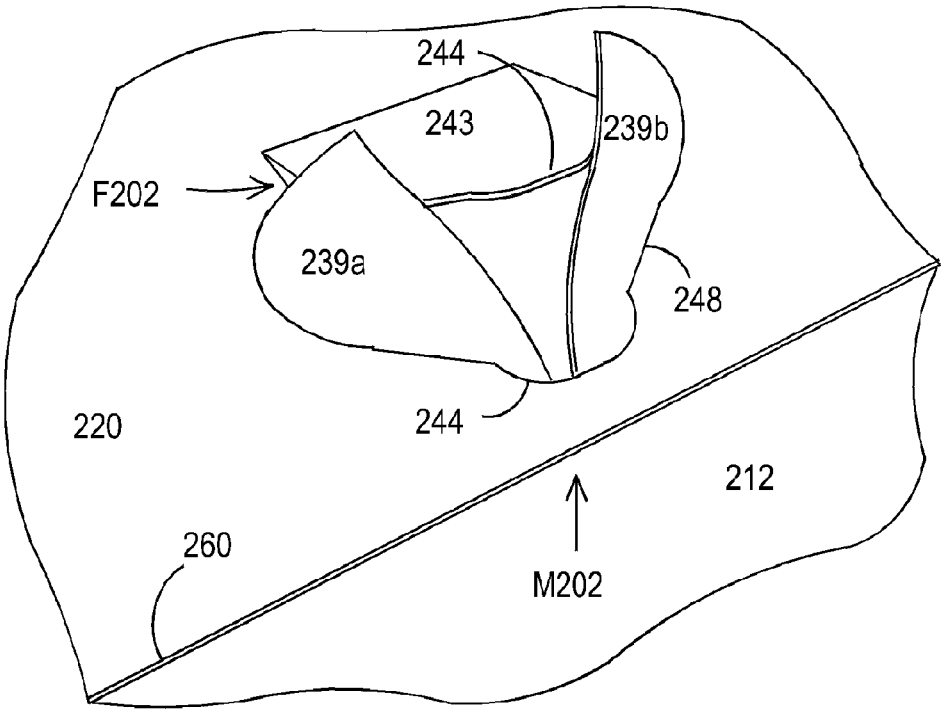
FIG. 10 is a perspective view of the "full-version" panel interlocking means of FIG. 9 shown in a locked configuration.
Figure 11:
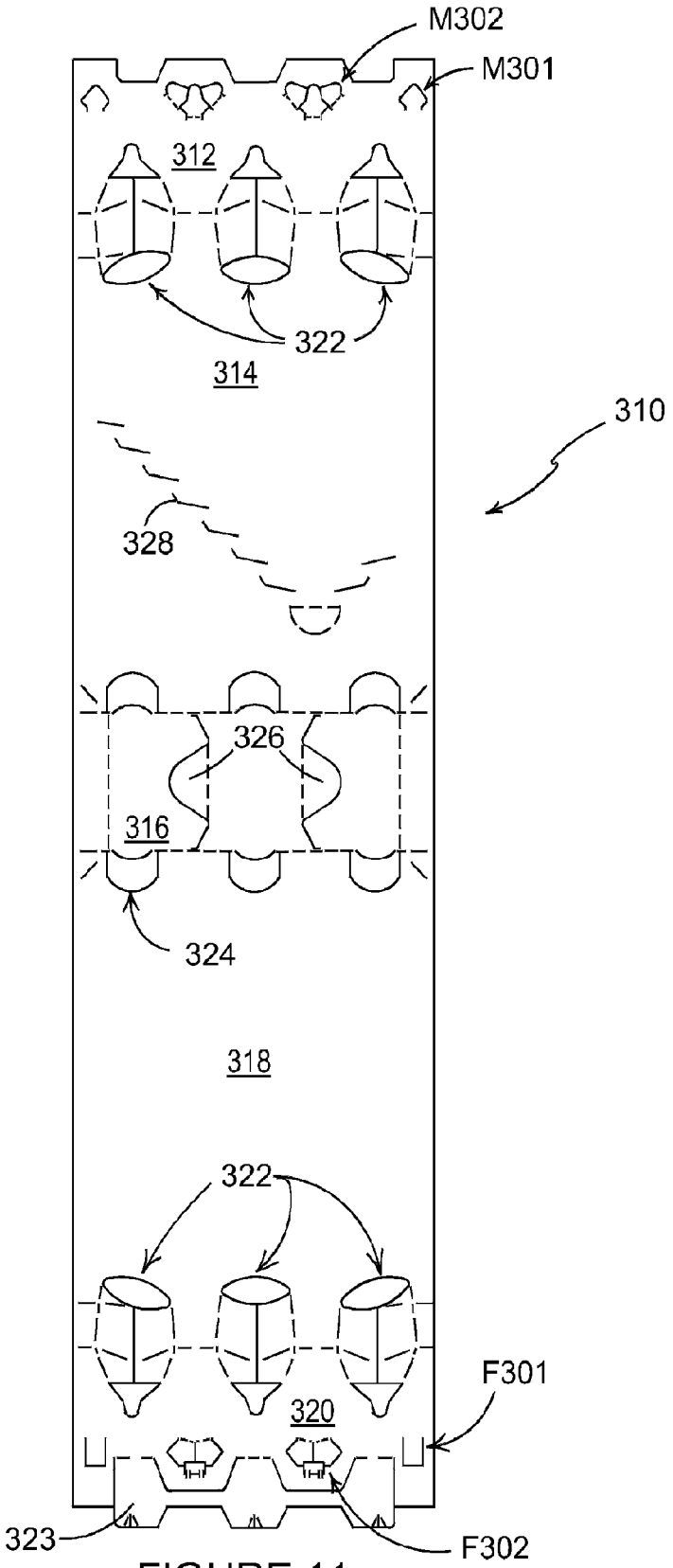
FIG. 11 is a plan view of a blank for forming a carton having a panel interlocking means according to a fourth embodiment of the present invention.

A third embodiment of the panel interlocking means is shown in FIG. 9. Again there are two variations (IM5 and IM6) of the interlocking elements of the third embodiment corresponding to a "half-version" (IM5) and a "full-version" (IM6). The variations of the third embodiment differ from those of the first embodiment in that the male tabs 239, 239*a*, 239*b* are shaped in a more exaggerated and bulging manner. Additionally, the male tabs 239, 239*a*, 239*b* comprise a short straight side edge 237. The bulged portions 236 cooperate with the respective oblique fold lines 241 (as well as the center cut line 232*a*) such that the bulged portions 236 somewhat move outwardly of the locking aperture (which is formed when the female tab 243 is displaced out of the plane of second bottom panel 220) as the male tabs 239, 239*a*, 239*b* are inserted and are thus split open or otherwise folded about the fold lines 241. Such outward movement of the male locking tabs 239, 239*a*, 239*b*, deepens or strengthens the engagement of the locking male tab 239, 239*a*, 239*b* within the locking aperture. This is because the bulged portions 236 engage with a portion of the side edge or edges 'E' of the locking aperture, particularly at the area adjacent the short straight side edge or edges 237. In fact the bulged portions 236 overhang the second bottom panel 220 and restrict any further backward movement of the male tabs 239, 239*a* and 239*b* such that the male tabs 239, 239*a*, 239*b* provide stronger opposition to the female tabs 243 returning to their unfolded state and thus enhancing the secure locking capability of the interlocking arrangement.

Preferably, fold lines of the male tabs 239, 239*a*, 239*b* are angled similarly to the oblique edges of the female tab 243 and consequently to the corresponding portion of the locking aperture, so as to encourage the male tabs 239, 239*a*, 239*b* to hinge about their fold lines 241.

The fold lines 241 of the male tabs and at least a portion of oblique edges (E) of a locking aperture edge (E) are substantially overlaid in parallel relationship.

The male tabs include a bulged shoulder portions shaped and sized to engage opposed side edges of a locking aperture.

The side edges of a locking aperture are formed in the second panel once the female tab is displaced out of the plane of the second panel.

It can be appreciated that various changes may be made without departing from the scope of the present invention, for example, the size and shape of the locking tabs 43; 143, 39; 39*a*, 39*b*, 139; 139*a*, 139*b* may be adjusted to accommodate panels of differing size or shape.

Furthermore whereas cut line 32, 32*a*; 132, 132*a* has been described as linear in other embodiments the cut line is shaped and is non-linear. It is preferable that the cut line 32, 32*a*; 132, 132*a* is shaped in complimentary fashion to the nook between the head 44; 144 and adjacent oblique shoulder portion 48; 148. In this way the edge of the male tabs 39; 39*a*, 39*b*, 139; 139*a*, 139*b* defined by the cut line 32, 32*a*; 132, 132*a* can be caught in that nook to improve the secure engagement of the interlocking mechanism. In some embodiments of the invention the or each male tabs 39; 39*a*, 39*b*, 139; 139*a*, 139*b* is provided with a grove, cut out or niche to further strengthen the engagement of the male tab 39; 39*a*, 39*b*, 139; 139*a*, 139*b* with the catch or nook or nick provided between the head 44; 144 and adjacent shoulder portion 48; 148 of the female tab 43; 143.

Fold line 41; 141 has been described and illustrated as entirely optional. It will be understood that in some circumstances demarcating a fold line can facilitate the controlled displacement of the male tab 39; 39*a*, 39*b*, 139; 139*a*, 139*b* out of the plane of the first bottom panel 12; 112. This is particularly beneficial where the fold line 41; 141 becomes aligned with the edge in the second bottom panel 20; 120 created by the oblique shoulder portion 48; 148 of the female tab 43; 143 'E'. As such it is desirable for the fold line 41; 141, when present, to be aligned with the edge E created by and shaped similarly to the oblique shoulder portion 48; 148 of the female tab. It is envisaged that in other embodiments, the shoulder portion 48; 148 of the female tab may not be straight edged and may be angled differently to that illustrated and described. In such arrangements it would be beneficial to facilitate the folding of the male tab 39; 39*a*, 39*b*, 139; 139*a*, 139*b* in alignment with that shaped shoulder portion 48; 148 and the optional fold line 41; 141, if provided, would be shaped in a complimentary fashion thereto. In this way the underside face of the male tab 39; 39*a*, 39*b*, 139; 139*a*, 139*b* can be made to engage and be held in abutting contact with the shaped shoulder portion 48; 148 of the female tab 43; 143. In some circumstances demarcating a fold line to facilitate the displacement of the male tab 39; 39*a*, 39*b*, 139; 139*a*, 139*b* out of the plane of the first bottom panel 12; 112 can reduce the natural resilience of the paperboard to want to return to its unfolded position. This may be of particular importance or benefit where the second method of folding is concerned. In such arrangements, advantage can be taken of the off-set arrangement of the terminus of cut line 32, 32*a*; 132, 132*a* and terminus 36 of arcuate cut line 34. The male tab 39; 39*a*, 39*b*, 139; 139*a*, 139*b* is encouraged to crease between these terminals and as such this off-set arrangement facilitates the angular folding of the male tab in a manner that is complimentary to the shape of the shoulder portion 48; 148 of the female tab so that the two tabs can be held in locking abutment.

In a further non-illustrated embodiment, the female tabs 43; 143 are provided with a demarcating fold line to facilitate the displacement of the female tabs 43; 143 out of the plane of the second bottom panel 20; 120. The fold line is provided between the terminals 46; 146 in the "full-version" and between terminus 46; 146 and the terminus of the linear cut line 42; 142.

Furthermore, the shape and size of locking head 44; 144 may be varied from that described and illustrated. In other embodiments the locking head 44; 144 is angular rather than rounded, for example square shaped or trapezoidal shaped, or triangular (as non-limiting examples of alternative shapes). It is also envisaged that the locking head comprises two distinct elements, each for optionally providing a nook for catching the edge of the a male tab 39, 39*a*, 39*b*; 139, 139*a*, 139*b* and preferably said distinct elements are spaced apart to provide a means for causing the male tabs 39*a*; 39*b*; 139*a*, 139*b* to be folded away from one another. Such a locking head 44; 144 may have a "horseshoe" style shape. Such a locking head is more beneficially provided in the "full-version" interlocking arrangement wherein the split 32*a*; 132*a* is disposed between a pair of male tabs 39*a*, 39*b*; 139*a*, 139*b*.

Other variations may also be made within the scope of the invention. For example the size, shape, position and number of interlocking means may be altered. The sides of the female tab 43; 143 are not straight edges on other embodiments.

Furthermore it is envisaged that in applications where more than one interlocking means is utilized in a panel locking application, that only "full-versions" of the interlocking means could be used; only "half-portions" of the interlocking means could be used; or a combination of "full-versions" and "half-versions" are used. In any of the foregoing combinations, the interlocking means may be provided with all female elements on one panel and all male elements on another panel, or with a mixture of female and male elements on each panel (in which case female elements on one panel would be aligned with a male element of the other panel). In such situations some of the panel interlocking elements would be interlocked using the first method of interlocking where the female element overlays the male element to start with whereas others of the panel interlocking means would be interlocked using the second method of interlocking wherein the male element overlays the female element to start with.

In applications where more than one interlocking means is utilized in a panel locking application the adjacent panel interlocking means are not necessarily disposed along the same longitudinal axis of the panels. Indeed one beneficial aspect of the invention is that the interlocking means are compact (have a small foot-print), particularly the "half-versions" (IM1, IM3) which can be disposed in small areas of the interlocked panels. As can be seen in FIG. 3, the composite bottom wall of a wrap-around style carrier supports articles and the upstanding tabs 43; 143, 39; 39*a*, 39*b*, 139; 139*a*, 139*b* need to be disposed in gaps between these articles. In efficient packaging, these gaps can be small and awkwardly positioned. However the interlocking means of the present invention can still be used in such arrangements.

A further illustrated embodiment of the present invention is shown in FIGS. 11 to 16.

The first and second bottom panels 312, 320 of the blank 310 are provided with panel interlocking means IM7 according to a fourth illustrated embodiment.

Figures 12A, 12B:
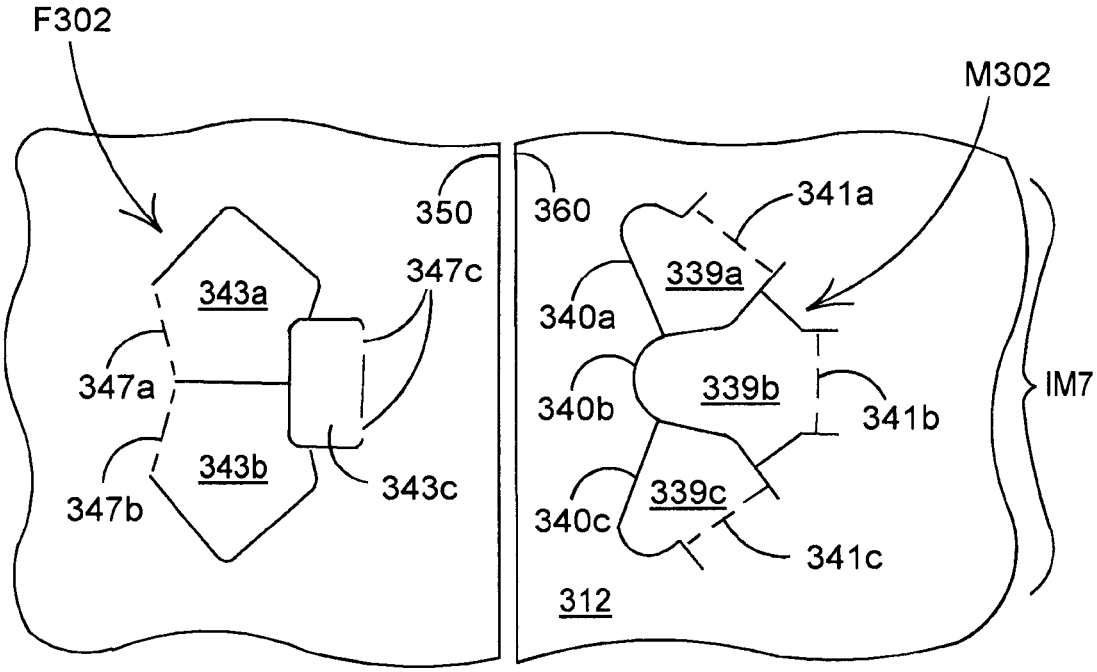
FIG. 12A is an enlarged plan view of a female element of the panel interlocking means according to the fourth embodiment of the invention.
FIG. 12B is an enlarged plan view of a male element of the panel interlocking means according to the fourth embodiment of the present invention.

A close up view of the first and second bottom panels 312, 320 is shown in FIG. 12A and 12B.

The panel interlocking means IM7 comprises a male element M302 and a female element F302. The male element M302 comprises three male tabs 339*a*, 339*b*, 339*c*.

First male tab 339*a* is hinged to first bottom panel 312 along first fold line 341*a*, second male tab 339*b* is hinged to first bottom panel 312 along a second fold line 341*b*, and third male tab 339*c* is hinged to first bottom panel 312 along a third fold line 341*c*.

The first, second and third fold lines 341*a*, 341*b*, 341*c* are each disposed at an angle with respect to one another.

Preferably, first and third fold lines 339*a*, 339*c* are perpendicular with respect to one another, more preferably, first and third fold lines are disposed at an angle of 45° with respect to one another.

The first, second and third male tabs 339*a*, 339*b*, 339*c* are struck from the first bottom panel 312 in a series, one adjacent to the next, such that the first and second male tabs 339*a*, 339*b* share, at least in part, a common line of severance and the second and third male tabs 339*b*, 339*c* share, at least in part, a common line of severance.

First male tab 339*a* comprises a shoulder portion and a waist portion disposed along a first side edge opposing a second side edge adjacent to the second male tab 339*b*.

Third male tab 339*c* comprises a shoulder portion and a waist portion disposed along a first side edge opposing a second side edge adjacent to the second male tab 339*b*.

Second male tab 339*b* comprises a pair of oppositely disposed shoulder portions and a waist portion along opposing side edges thereof.

Female element F302 comprises three female tabs 343*a*, 343*b*, 343*c*.

First female tab 343*a* and second female tab 343*b* are disposed adjacent one another and are substantially pentagonal in shape.

First and second female tabs 343*a*, 343*b* are hinged to second bottom panel 320 by first fold line 347*a* and second fold line 347*b* respectively.

First and second fold lines 347*a*, 347*b* are orientated at an angle with respect to a free end edge 350 of second bottom panel 320.

First and second fold lines 347*a*, 347*b* are orientated at an angle with respect to one another and preferably are in contact with one another at one end to form a vertex.

Third female tab 343*c* is substantially rectangular in shape.

Third female tab 343*c* is hinged to the second bottom panel 320 along a fold line 347*c*.

Third female tab 343*c* is hinged to the second base panel 320 such that it folds in the opposite direction to that of the first and second female tabs 343*a*, 343*b*. Third fold line 343*c* is disposed closer to the free end edge 350 of second bottom panel 320 than a free end edge of the third female tab 343*c*.

Third female tab 343*c* is struck in part from both first and second female tabs 343*a*, 343*b* such that the first and second female tabs 343*a*, 343*b* comprise a recessed portion disposed at a free end edge thereof.

Figure 13:
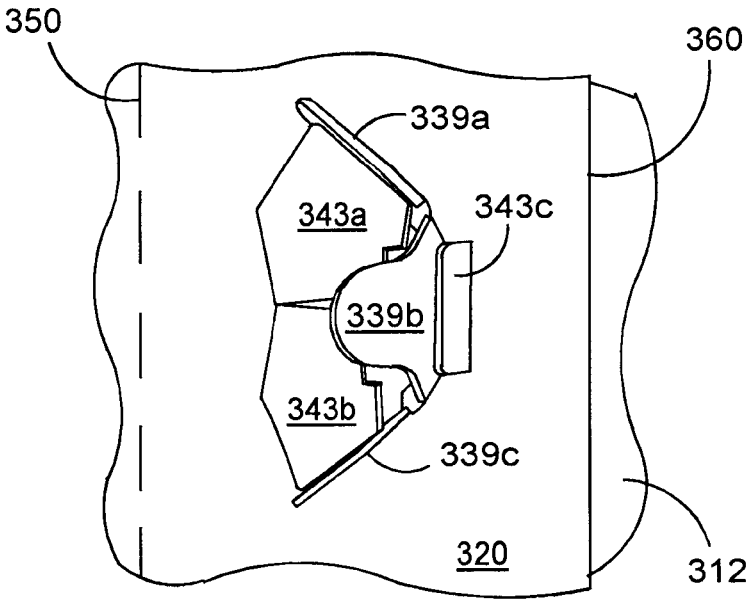
FIG. 13 is a plan view of the panel interlocking means of FIGS. 11 to 12B in a deployed configuration.

FIG. 13 illustrates a panel interlocking means of the fourth illustrated embodiment in a set up condition. Second panel 320 has been arranged to at least partially overlap with first panel 312.

Male tabs 339*a*, 339*b*, 339*c* have been folded out of the plane of the first panel 312 and through an aperture in second panel 320 formed by displacing the female tabs 343*a*, 343*b*, 343*c* out of the plane of the second panel 320.

A side edge of first female tab 343*a* is in contact with an external free of the first male tab 339*a*.

A side edge of second female tab 343*b* is in contact with an external face of third male tab 343*c*. In this way first and second female tabs 343*a*, 343*b* maintain first and third male tabs 339*a*, 339*c* in a folded position.

Second male tab 339*b* is held in a folded position by both first and second female tabs 343*a*, 343*b*.

Second male tab 339*b* is received in a recess formed in first female tab 343*a*, when the third female tab 343*c* is folded out of the same plane as the first female tab 343*a*.

Second male tab 339*b* is also received in a recess in second female tab 343*b* when the third female tab 343*c* is folded out of the same plane as the first female tab 343*a*. In this way the first and second female tabs 343*a*, 343*b* each receive a portion of the second male tab 339*b* in a respective recessed portion and held in a deployed position.

Third female tab 343*c* is folded out of the plane of the second panel 320, preferably simultaneously with the folding of the second male tab 339, out of the plane of the first panel 312.

An external force and/or end edge of the third female tab 343*c* engages with an internal face of the second male tab 339*b*. In this way the third female tab 343*c* encourages the second male tab 339*b* to maintain engagement first and second female tabs 343*a*, 343*b* preferably within the recesses thereof.

Figure 14:
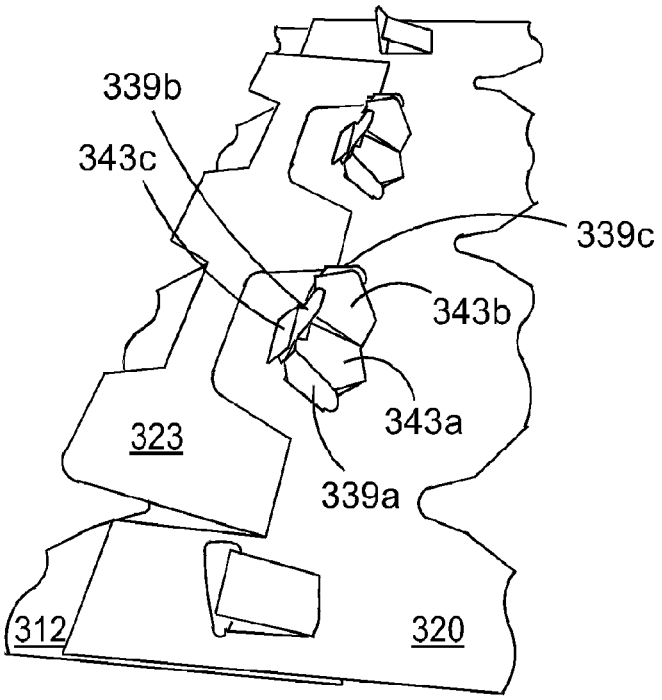
FIG. 14 is a perspective view from above right of an internal portion of a carton having the panel interlocking means of FIG. 11 in a deployed position.
Figure 15:
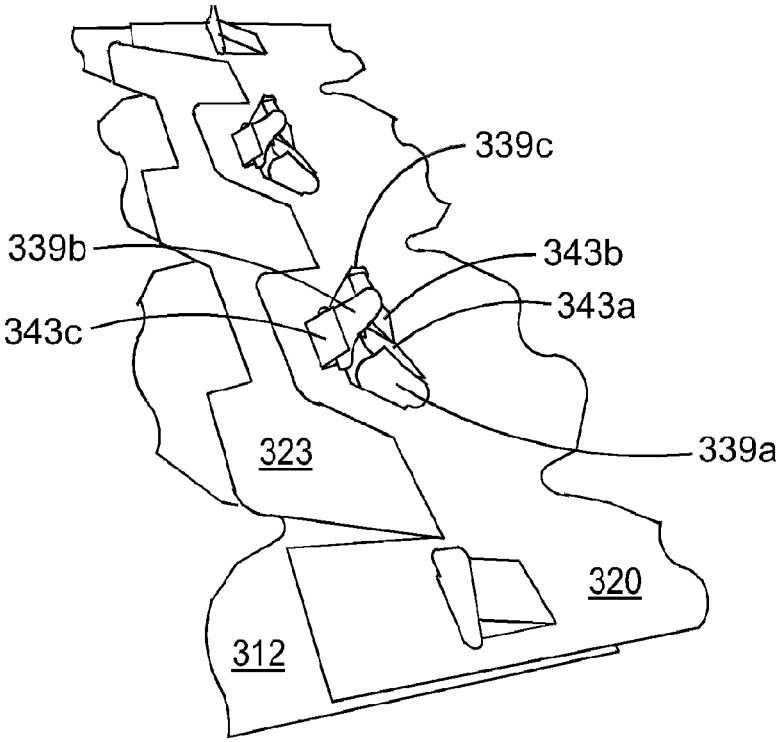
FIG. 15 is a perspective view from above left of an internal portion of a carton having the panel interlocking means of FIG. 11 in a deployed position.
Figure 16:
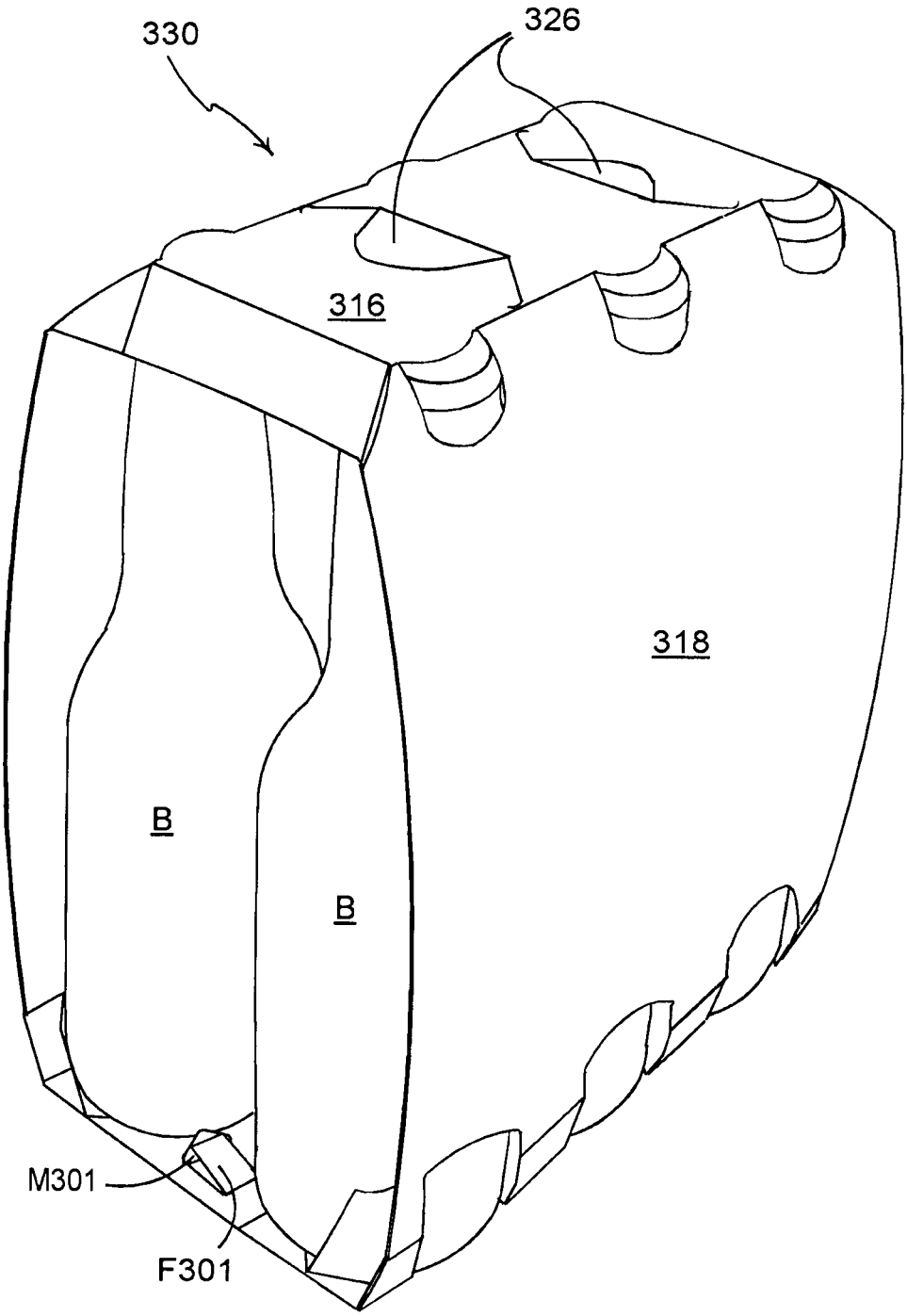
FIG. 16 is a perspective view from above of a carton formed from the blank of FIG. 11.

FIGS. 14 and 15 illustrate an internal portion of a carton 330 in which the panel interlocking means IM7 is in a deployed state. An optional keel structure 323 may be deployed between two rows of articles (not shown). Optionally the keel structure 323 may engage with one or more of the male or female tabs 339*a*, 339*b*, 339*c*, 343*a*, 343*b*, 343*c* to hold the keel structure in position and/or to provide additional securing means to hold the male tabs 339*a*, 339*b*, 339*c* in an interlocking position.

Figure 17:
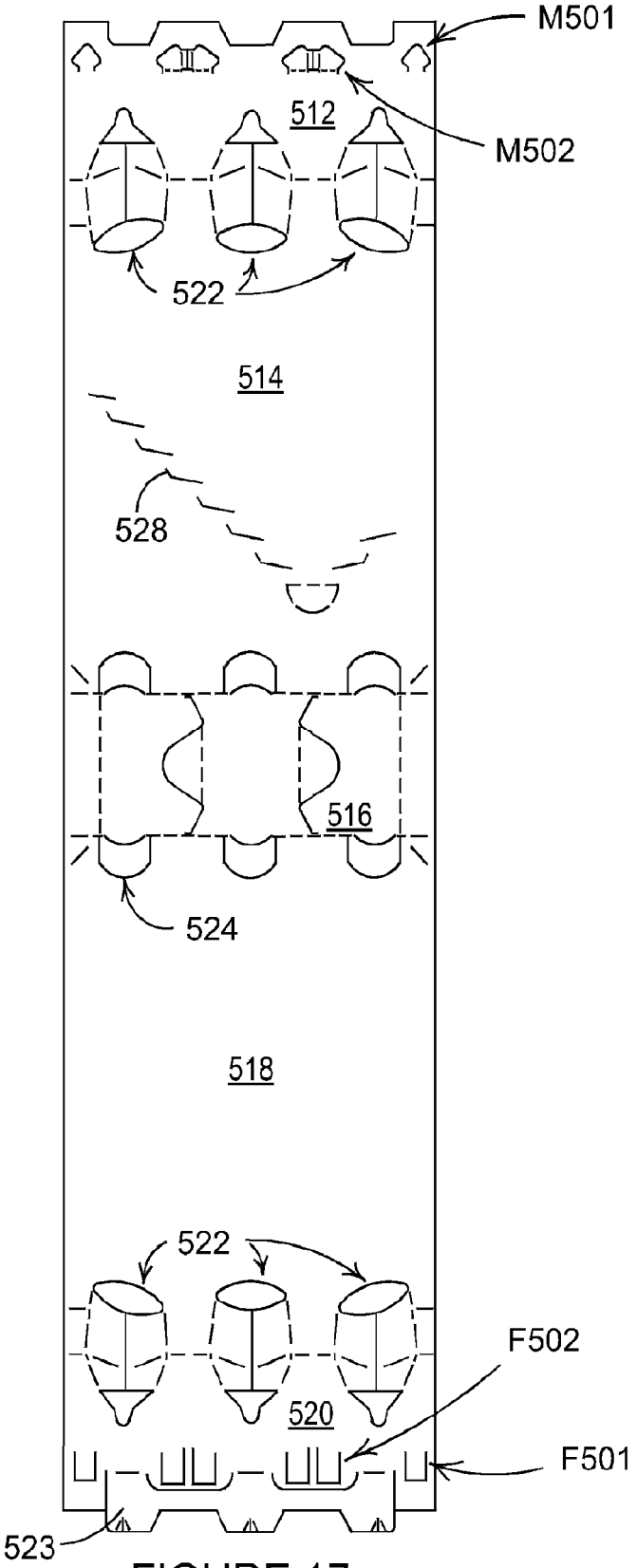
FIG. 17 is a plan view of a blank for forming a carton having a panel interlocking means according to a fifth embodiment of the present invention.

FIG. 17 illustrates a blank 510 for forming a carton 530 according to a fifth illustrated embodiment of the present invention.

The first and second bottom panels 512, 520 of the blank 510 are provided with panel interlocking means IM8 according to a fifth illustrated embodiment.

Figure 18:
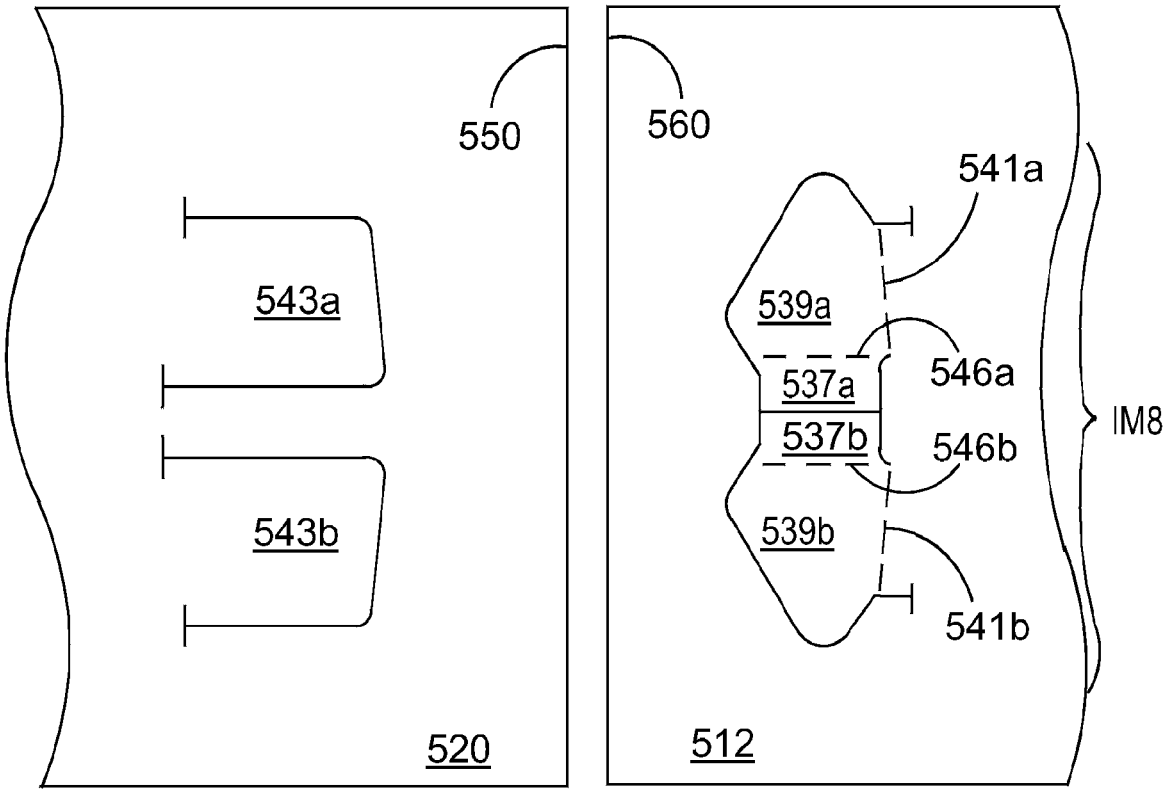
FIG. 18 is an enlarged view of the male and female elements of the panel interlocking means according to the fifth embodiment of the present invention.

A close up view of the first and second bottom panels 512, 520 is shown in FIG. 18.

The panel interlocking means IM8 comprises male element M502 and female element F502. The male element M502 comprises two male tabs 539*a*, 538*b*.

First male tab 539*a* is hinged to a first bottom panel 512 along first fold line 541*a*, second male tab 539*b* is hinged to the first bottom panel 512 along a second fold line 541*b*.

The first and second fold lines 541*a*, 541*b* are each disposed at an angle to one another.

The first and second male tabs 539*a*, 539*b* are struck from the first bottom panel 512 adjacent to one another in a series, such that the first and second male tabs 539*a*, 539*b* share, at least in part, a common line of severance.

First male tab 539*a* comprises a shoulder portion and a waist portion disposed on a first side edge opposing a second side edge adjacent to the second male tab 539*b*.

Second male tab 539*b* comprises a shoulder portion and a waist portion disposed on a first side edge opposing a second side edge adjacent to the first male tab 539*a*.

Each of the male tabs 539*a*, 539*b* comprise a foldable locking element 537*a*, 537*b* hinged to a respective one of the male tabs 539*a*, 539*b* along a fold line 546*a*, 546*b* respectively and disposed along the second side edge.

Female element F502 comprises two female tabs 543*a*, 543*b*.

First female tab 543*a* and second female tab 543*b* are disposed adjacent to and spaced apart from one another and are substantially trapezoidal in shape.

First and second female tabs 543*a*, 543*b* are hinged to second bottom panel 520 by a first fold line 547*a* and a second fold line 547*b* respectively.

First and second fold lines 547*a*, 547*b* are orientated at an angle to a free end edge 550 of second bottom panel 520.

First and second fold lines 547*a*, 547*b* are orientated at an angle with respect to one another.

Figure 19:
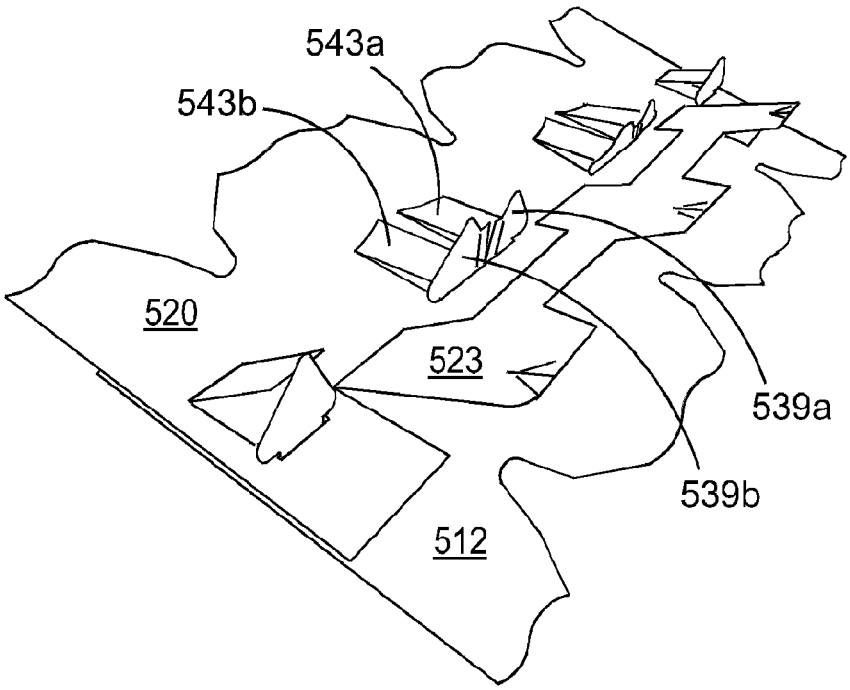
FIG. 19 is a perspective view from above right of an internal portion of a carton having a panel interlocking means according to the fifth embodiment of the present invention.
Figure 20:
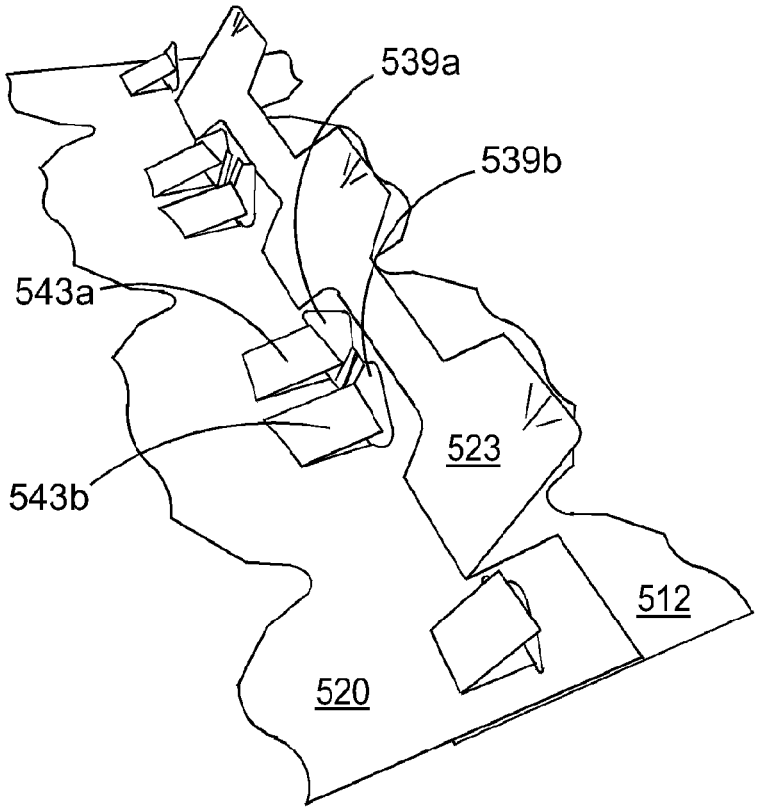
FIG. 20 is a perspective view from above left of an internal portion of a carton having a panel interlocking means according to a fifth embodiment of the present invention.

FIGS. 19 and 20 illustrate an internal portion of a carton 530 in which the articles B have been removed illustrative purposes. The panel interlocking means IM8 is in a deployed condition.

Male tabs 339*a*, 539*b* have been folded out of the plane of first base panel 512 and received through an aperture in the second base panel 520 formed by displacement of the first and second female tabs 543*a*, 543*b* out of the plane of the second base panel 520.

Preferably the female tabs 543*a*, 543*b* are folded simultaneously with the male tabs 539*a*, 539*b*.

The foldable locking elements 537*a*, 537*b* fold about the fold lines 546*c*, 546*b* to allow the respective male tabs 539*a*, 539*b* to pass through the aperture defined by the respective female tabs 543*a*, 543*b*.

The foldable locking element 537*a*, 537*b* then unfold at least partially, or return to the plane of the male tabs 539*a*, 539*b* due to the inherent resilience of the material from which the carton 550 is formed.

A locking edge of the foldable locking element 537*a*, 537*b* which engages with the second base panel 520 so as to prevent the respective male tabs 539*a*, 539*b* passing through the aperture defined by the respective female tabs 543*a*, 543*b*, thereby locking the male tabs 539*a*, 539*b* in a deployed position.

A sixth illustrated embodiment is illustrated in FIGS. 21 to 24.

Figure 21:
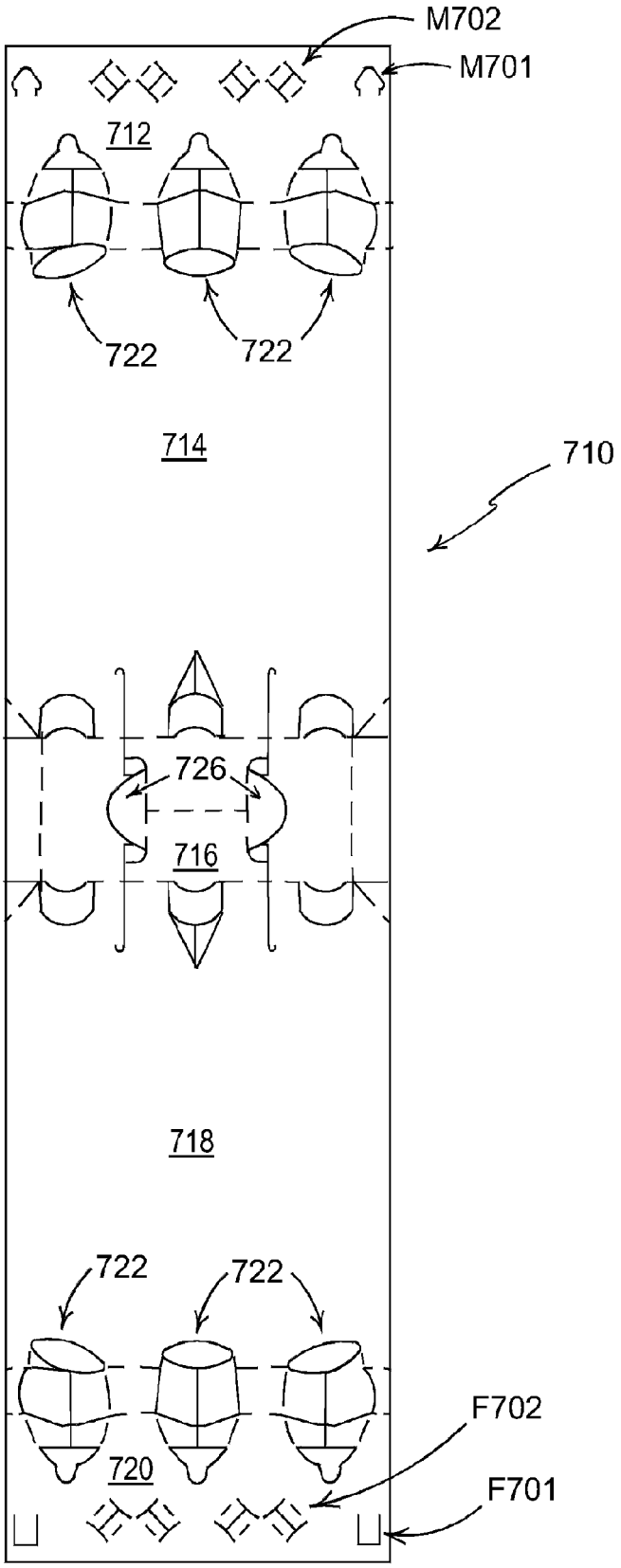
FIG. 21 is a plan view of a blank for forming a carton having a panel interlocking means according to a sixth embodiment of the present invention.

FIG. 21, illustrates a blank 710 of foldable sheet material, such as paperboard or plastics, for forming a wraparound style carton.

The blank 710 comprises a plurality of panels arranged in series and hinged one to the next including: a first bottom panel 712, a first side panel 714, a top panel 716, a second side panel 718 and a second bottom panel 720. The blank 710 further comprises a number of entirely optional features for securing the articles B within the carton 730 once formed, these include: heel locking apertures 722, tear access opening means 728, bottle top securing apertures 724 and handling means 726.

The first and second bottom panels 712, 720 of the blank 710 are provided with panel interlocking means IM9 according to a sixth embodiment of the invention.

Figure 22:
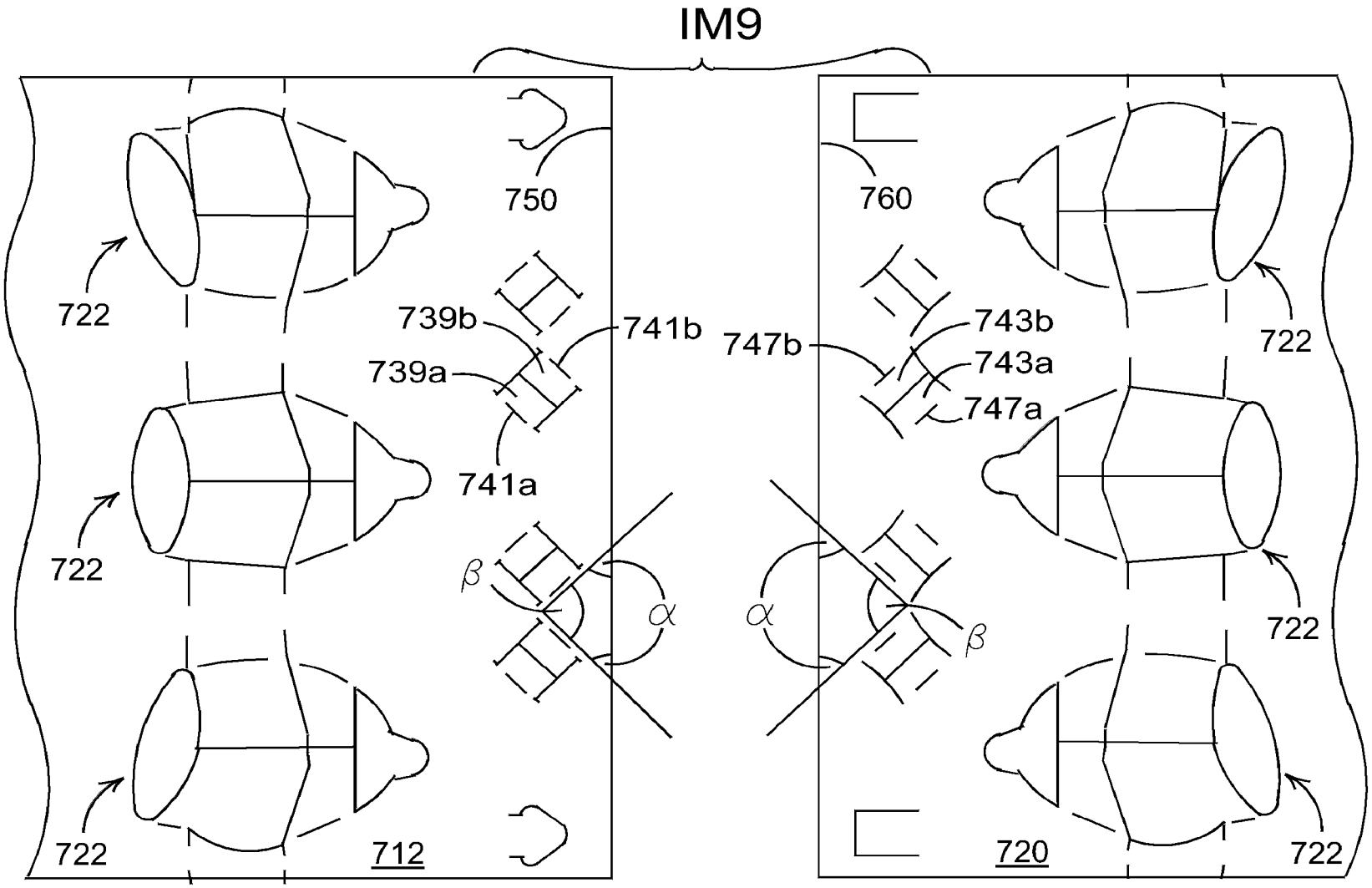
FIG. 22 is an enlarged plan view of a male and female elements of the panel interlocking means of FIG. 21.

FIG. 22 illustrates the panel interlocking means IM9 in further detail. The panel interlocking means IM9 comprises a first punch lock having male element M701 which mates with female element F301. Female element F701 comprises a substantially rectangular shaped tab defined at least in part by a "U" shaped line of severance. Male element M701 comprises an arrowhead shaped tab which arrowhead points toward the free end edge of the first bottom panel 712.

The panel interlocking means IM9 also comprises a second punch lock according to a sixth embodiment of the present invention; the punch lock comprises a male element M702 and a female element F702. The female element F702 is illustrated in greater detail in FIG. 23*a* and comprises a pair of female tabs 743*a*, 743*b* which are rectangular or substantially trapezoidal in shape, which are defined, at least in part, by a "H" shaped line of severance. The pair of female tabs 743*a*, 743*b* each comprises a hinged connection 747*a*, 747*b* to the second base panel 720.

Preferably, the side edges of each of the female tabs 743*a*, 743*b* are accurately shaped. The female tabs 743*a*, 743*b* have a length Xf.

Preferably, the female tabs 743*a*, 743*b* are tapered in shape such that they have a width Yf1 at the point of the hinged connection to the second base panel 720 and have a width Yf2 at a free end edge wherein the width Yf2 is preferably less than the width Yf1.

Figure 23B:
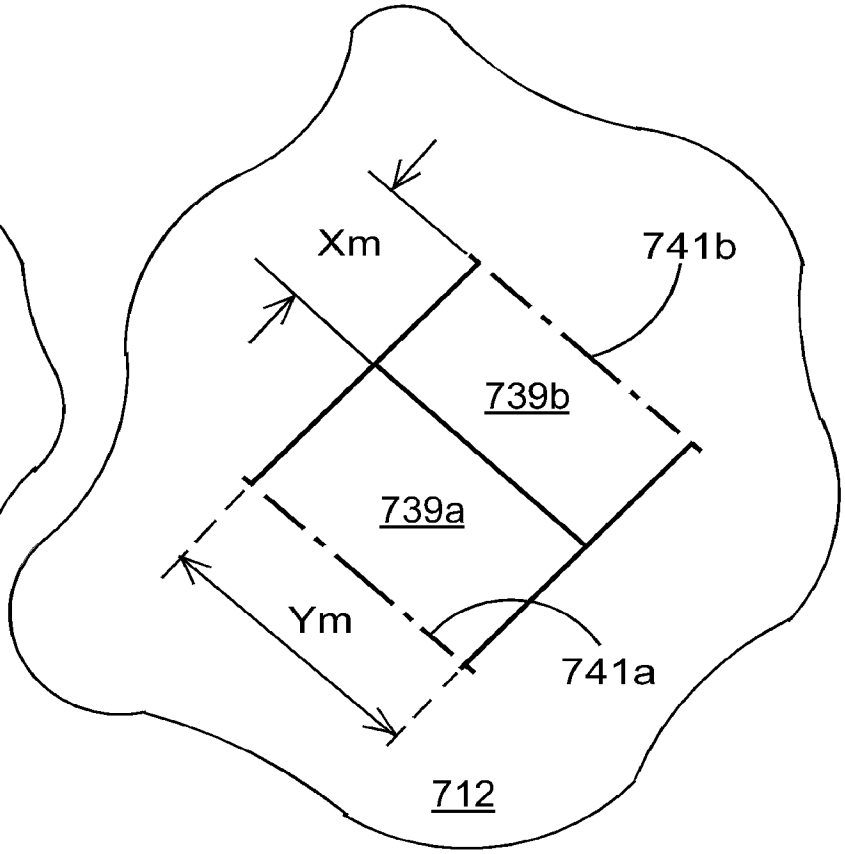
FIG. 23*b* is an enlarged plan view of a male element according to a sixth embodiment of the present invention.
Figure 23A:
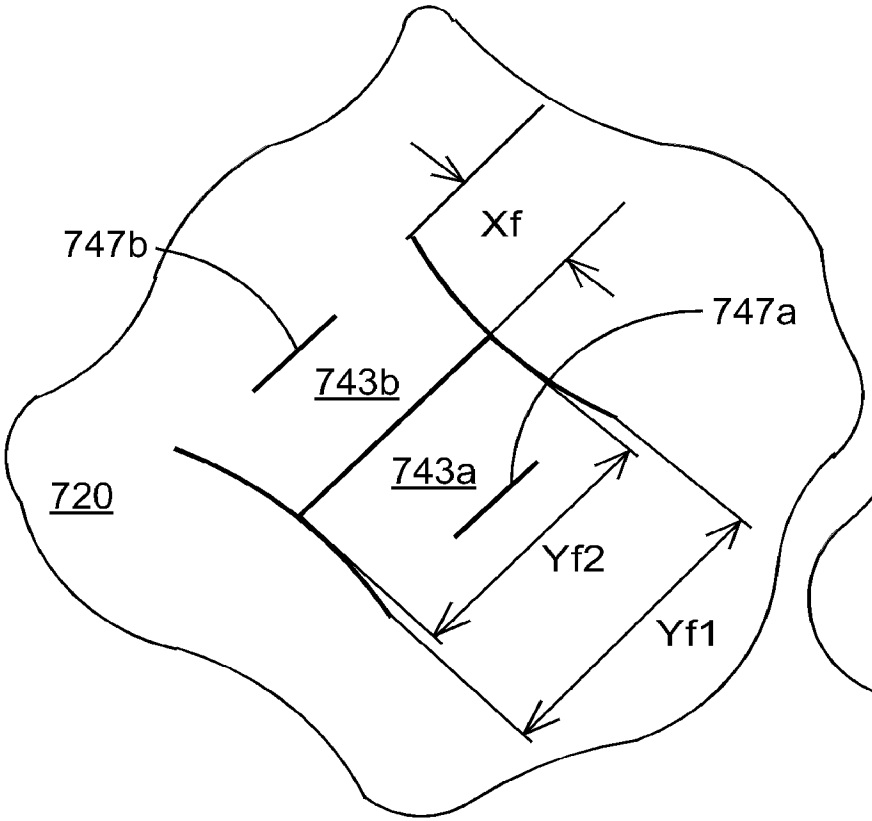
FIG. 23*a* is an enlarged plan view of a female element according to a sixth embodiment of the present invention.

The male element M302 is illustrated in FIG. 23B and comprises a pair of male tabs 739*a*, 739*b* which are defined in part by an "H" shaped line of severance. Each of the male tabs 739*a*, 739*b* is hinged to the first male panel 712 along fold line 741*a*, 741*b*. Preferably the male tabs 739*a*, 739*b* are rectangular in shape and have a length Xm and a width Ym. In the preferred embodiment the length Xm of the male 739*a*, 739*b* is greater than the Xf of the female tabs 747*a*, 747*b*.

In the preferred embodiment the hinged connection 741*a*, 741*b* of the male tabs 739*a*, 739*b* to the first base panel 712 is defined by an embossed line or score line, preferably the embossed line is longer than the hinged connection 747*a*, 747*b*.

The hinged connection 747*a*, 747*b* between the female tabs 743*a*, 743*b* and the second base panel 720 are also defined, at least in part, by an embossed line or score line, preferably the score line is shorter than the hinged connection.

Referring to FIG. 22, it can be seen that the male and female tabs 739*a*, 739*b*, 743*a*, 743*b* are disposed at an angle $\alpha$ to a free end edge 750, 760 of the respective first and second base panels 712, 720. Preferably the angle $\alpha$ is 45°.

In the preferred embodiment a pair of locking means are arranged adjacent one another and at an angle $\beta$ to one another preferably the pair of locking means are disposed perpendicularly with respect to one another, and more preferably arranged such that both of the locking means are provided within an area of the respective base panel 712, 720 which is defined, in part, by a pair of adjacent article receiving means 722.

In a set up package a pair of locking means are positioned in registry with a void defined between two adjacent articles in a first row of articles B and two adjacent articles B in a second row of articles B.

Turning to the construction of a carton from blank 710, it is envisaged that the carton can be formed by a series of sequential folding operations in a straight line machine so that the carton is not required to be rotated or inverted to complete its construction. The folding process is not limited to that described below and may be altered according to particular manufacturing requirements.

The carton is formed by wrapping the blank 710 of FIG. 21 about a group of articles B and engaging the male elements M701, M702 of the panel interlocking means IM9 with the female elements F701, F702 to form a carton.

Figure 24:
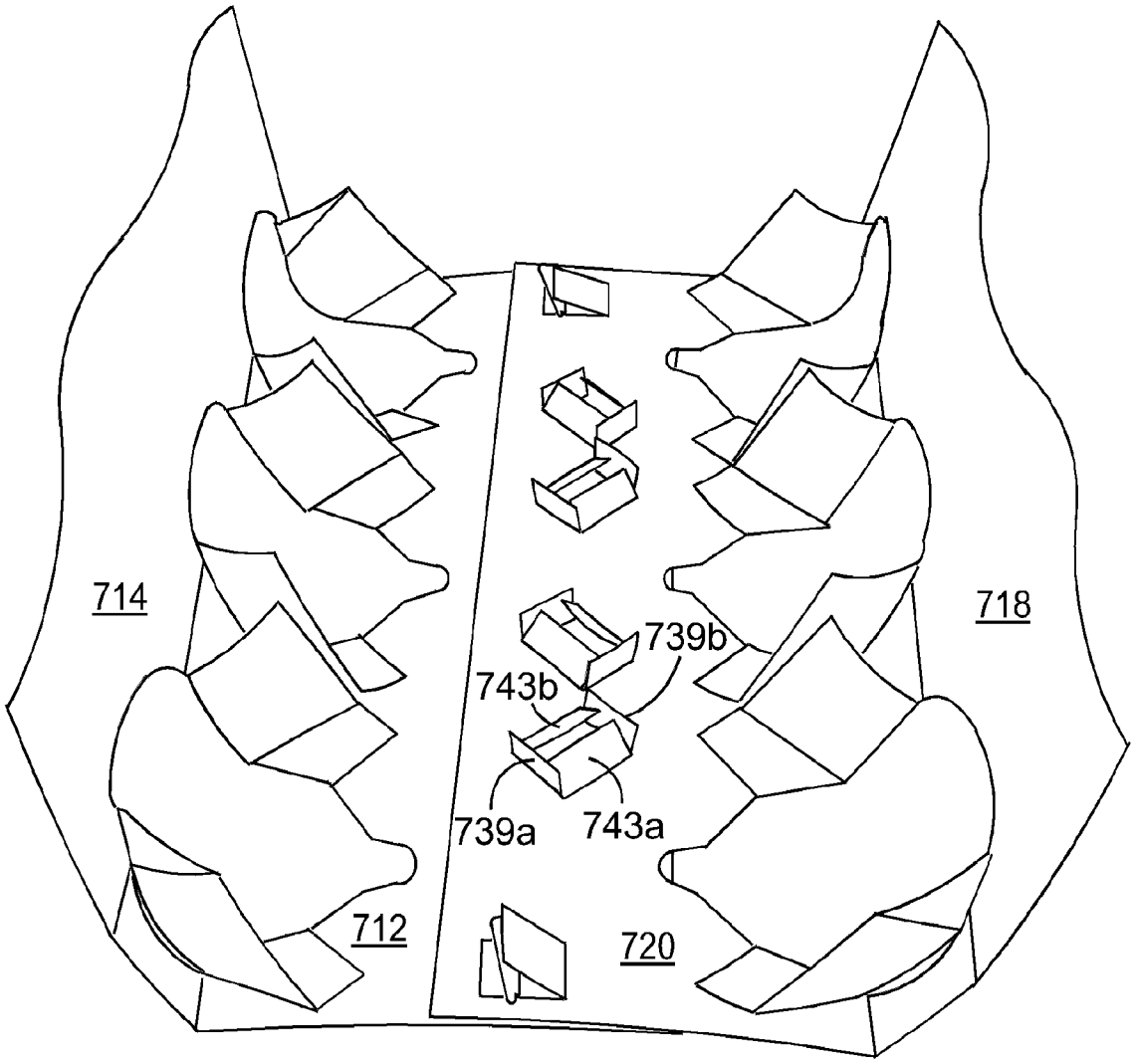
FIG. 24 is a perspective view from above of an internal portion of a carton having a panel interlocking means according to a sixth embodiment of the present invention.

FIG. 24 shows an internal portion of the base of a carton formed from the blank 710 of FIG. 21 the articles B have been removed for illustrative purposes.

The second base panel 720 has been folded internally of the first base panel 712 in an overlapping relationship thereto.

The male and female elements M701, M702, F701, F702 of the panel interlocking means IM9 are in registry with one another. The male tabs 739*a*, 739*b* have been folded out of the plane of the first base panel 712 and inserted through the second base panel 720, through an aperture in the second base panel 720 formed by folding the female tabs 743*a*, 743*b* out of the plane of the second base panel 720.

The female tabs 743*a*, 743*b* have been arranged so that side edges of the female tabs 743*a*, 743*b* engage with an external face of the male tabs 739*a*, 739*b* such that the male tabs 739*a*, 739*b* are maintained in a folded position preferably, folded so as to form an arcuate angle between an internal face of the male tabs 739*a*, 739*b* and an internal face of the second base panel 720. In other words the male tabs 739*a*, 739*b* are folded out of the plane of the first base panel 712 by more than 90° and are maintained in that position by the female tabs 743*a*, 743*b*. The arcuate nature of the side edges of the aperture formed in the second base 720 panel acts upon the male tabs 739*a*, 739*b* causing them to bend about the side edges of the aperture.

The tapered shape of the female tabs 743*a*, 743*b* acts upon the male tabs 739*a*, 739*b* so that the female tabs 743*a*, 743*b* and the second base panel 720 tighten about the male tabs 739*a*, 739*b*, gripping the male tabs 739*a*, 739*b* between the edge of the aperture in the second base panel 720 and the side edge of the female tabs 743*a*, 743*b*. It is envisaged this occurs naturally due to the inherent resilient quality of the material the carton 730 is constructed from, the female tabs 743*a*, 743*b* will be resiliently biased to return to the plane of the second base panel 720. It is envisaged that by providing an embossed line or score line only partially along the length of the hinged connection between the female tabs 743*a*, 743*b* and the second base panel 720 more of the natural resilience of the material will be retained.

It will also be apparent that the locking mechanism of the present invention could be applied to a variety of cartons and its application is not limited to a wraparound carton. It is also clear that the interlocking slit and tab could be formed from opposite ends of a unitary blank, or indeed from two separate panels.

It will also be recognized that as used herein, any reference to hinged connection should not be construed as necessarily referring to a single fold line only; indeed it is envisaged that hinged connection can be formed from one or more of the following, a score line, a frangible line or a fold line without departing from the scope of the invention.

The invention claimed is:

1. An arrangement for locking together first and second panels, the arrangement comprising a first and second male tabs struck from the first panel and at least one female tab wherein the first and second male tabs are hinged to the first panel by first and second fold lines respectively and extend from the first and second fold lines substantially toward a free end edge of the first panel, and the at least one female tab is foldably connected to the second panel and defines at least one locking aperture in the second panel when folded out of a plane of the second panel, the first and second fold lines being divergent with respect to one another and extend divergently toward the free end edge of the first panel, and wherein the first and second male tabs are foldable about the first and second fold lines into a deployed position wherein the first and second male tabs are received in the at least one locking aperture to secure the first and second panels together, and wherein the at least one female tab has first and second distal edges which are not parallel to one another, the first and second male tabs abut at undersides thereof on the first and second distal edges respectively when the first and second male tabs are in the deployed position.

2. An arrangement according to claim 1 wherein the first and second male tabs are oriented such that the first and second fold lines are disposed at an angular relationship to the free end edge of the first panel and wherein the first and second male tabs each is defined at least in part by a cut line formed in the first panel.

3. An arrangement according to claim 2 wherein the first and second fold lines are disposed to define therebetween an angle greater than 90°.

4. An arrangement according to claim 2 wherein the first and second fold lines are disposed at an angle of substantially 45° to the free end edge of the first panel.

5. An arrangement according to claim 2 wherein the first and second fold lines are arranged to define therebetween an angle of about 90 degrees.

6. An arrangement according to claim 1, further comprising a third male tab hinged along a third fold line to the first panel, wherein the first, second and third fold lines are each disposed divergently with respect to one another.

7. An arrangement according to claim 1 wherein the first and second fold lines are in contacting relationship with one another so as to form a vertex.

8. An arrangement according to claim 1 wherein the at least one female tab comprises first and second female tabs foldably connected to the second panel, and wherein the first and second distal edges are provided by the first and second female tabs respectively.

9. An arrangement according to claim 1 wherein the first and second distal edges of the at least one female tab are angled with respect to one another so as to encourage the first and second male tabs to fold along the first and second fold lines respectively.

10. An arrangement according to claim 1 wherein the first and second male tabs are shorter in width than the at least one female tab.

11. An arrangement for locking together first and second overlaid panels, the arrangement comprising a male lock formed in the first panel and a female tab formed in the second panel, the male lock is separable along a cut line into first and second male tabs, the first and second male tabs and female tab each comprising a base portion foldably connected to a respective one of the first and second panels, the female tab defining a locking aperture in the second panel when folded out of a plane of the second panel, in which the first and second male tabs are foldable into a deployed position where the first and second male tabs are received in the locking aperture and are spaced apart from each other with said female tab inserted between the first and second male tabs, wherein the cut line defines adjacent edges of the first and second male tabs, wherein the adjacent edges are in contact with each other when the first and second male tabs lie in a plane of the first panel and wherein the adjacent edges are spaced apart from each other and engage the female tab when the first and second male tabs are in the deployed position.

12. An arrangement according to claim 11 wherein the female tab comprises a shoulder portion and a head portion arranged to form a catch in which a side edge of at least one of the male tabs is engageable.

13. An arrangement according to claim 11 wherein the female tab comprises oblique edges which are not parallel to one another, and the male tabs are displaced such that the male tabs abut at undersides thereof on the oblique edges respectively.

14. An arrangement according to claim 13 wherein the male tabs respectively engage opposed side edges of the locking aperture when the male tabs are in the deployed position.

15. An arrangement according to claim 14 wherein the male tabs are encouraged to form natural hinges about edges of the locking aperture defined by the oblique edges of the female tab when the male tabs are in the deployed position.

16. An arrangement according to claim 11 wherein the male tabs are hingeable about fold lines angled obliquely relative to a notional central axis of each of the male tabs.

17. An arrangement according to claim 11 wherein each of said male tabs hinges about a fold line angled obliquely relative to the cut line such that the male tabs are encouraged to fold away from one another, wherein the female tab comprises two oblique edges and a head disposed between the oblique edges, the head being disposable between the male tabs when the male tabs are in the deployed position such that at least one of the adjacent edges of the male tabs engages with the head.

18. An arrangement according to claim 11 wherein the male tabs comprise bulged shoulder portions shaped and sized to engage opposed side edges of the locking aperture.

* * * * *